US007712881B2

(12) United States Patent
Kobayashi

(10) Patent No.: US 7,712,881 B2
(45) Date of Patent: May 11, 2010

(54) APPARATUS FOR ATTACHING AND DETACHING INK CARTRIDGE, RECORDER COMPRISING THE SAME AND LIQUID SPRAYING APPARATUS COMPRISING THE SAME

(75) Inventor: Satoshi Kobayashi, Kitakyusyu (JP)

(73) Assignee: Seiko Epson Corporation, Tokyo (JP)

( * ) Notice: Subject to any disclaimer, the term of this patent is extended or adjusted under 35 U.S.C. 154(b) by 784 days.

(21) Appl. No.: 11/652,769

(22) Filed: Jan. 11, 2007

(65) Prior Publication Data

US 2007/0182781 A1 Aug. 9, 2007

(30) Foreign Application Priority Data

Jan. 11, 2006 (JP) ..... 2006-004028

(51) Int. Cl.
*B41J 2/175* (2006.01)

(52) U.S. Cl. ..... 347/86

(58) Field of Classification Search ..... 347/37, 347/84–87

See application file for complete search history.

(56) References Cited

U.S. PATENT DOCUMENTS

| | | | |
|---|---|---|---|
| 7,455,397 | B2 | 11/2008 | Sakai et al. |
| 2008/0136879 | A1 | 6/2008 | Sakai et al. |
| 2008/0291252 | A1 | 11/2008 | Sakai et al. |

FOREIGN PATENT DOCUMENTS

| | | |
|---|---|---|
| JP | 11-157094 | 6/1999 |
| JP | 2005254794 A | 9/2005 |
| JP | 2005254794 A | 9/2005 |

*Primary Examiner*—An H Do
(74) *Attorney, Agent, or Firm*—Nutter McClennen & Fish LLP; John J. Penny, Jr.

(57) ABSTRACT

An attaching and detaching device includes a cartridge holding unit configured to hold an ink cartridge by insertion of the ink cartridge by a first predetermined stroke and a power transmitting and converting mechanism configured to convert turning of a lever arm into motion of a second predetermined stroke required for mounting the ink cartridge while held by the cartridge holding unit. The cartridge holding unit includes an integrated engagement member configured to engage with a surface of the ink cartridge, the surface being parallel to a mounting direction. When engaging with the ink cartridge, the engagement member lies in a central portion in a width direction with respect to the mounting direction at the surface.

9 Claims, 29 Drawing Sheets

(A)

(B)

(A)

(B)

(A)

(B)

APPARATUS FOR ATTACHING AND DETACHING INK CARTRIDGE, RECORDER COMPRISING THE SAME AND LIQUID SPRAYING APPARATUS COMPRISING THE SAME

Priority is claimed under 35 U.S.C. §119 to Japanese Patent Application Number 2006-004028 filed on Jan. 11, 2006, which is hereby incorporated by reference in its entirety.

TECHNICAL FIELD

The present invention relates to an ink-cartridge attaching and detaching device for sliding an ink cartridge and mounting the ink cartridge on a main body of a recording apparatus, a recording apparatus including the attaching and detaching device, and a liquid ejecting apparatus including the attaching and detaching device.

A liquid ejecting apparatus used herein indicates an apparatus that is not limited to a recording apparatus, such as an ink jet recording apparatus, a copier, and a facsimile machine, that performs recording to a recording medium, such as recording paper, by ejecting ink to the recording medium, from a recording head as a liquid ejecting head, and another example of the liquid ejecting apparatus includes an apparatus that attaching liquid to an ejecting target medium by ejecting liquid for a specific application, instead of ink, to an ejecting target medium corresponding to a recording medium from a liquid ejecting head corresponding to the recording head. Examples of the liquid ejecting head include, in addition to the above-described recording head, a color-material ejecting head used in production of a color filter for a liquid crystal display or other apparatus, an electrode-material (conductive paste) ejecting head used in formation of an electrode for an organic electroluminescent (EL) display, a surface emitting display (FED), or other apparatus, a bioorganic-substance ejecting head used in production of a biochip, and a sample ejecting head as a precision pipette.

BACKGROUND ART

An ink jet printer is described below as one example of an ink jet recording apparatus or a liquid ejecting apparatus. For mounting an ink cartridge on an ink jet printer, a relatively great pressing force is required. In this case, for ink cartridges, one for each color, a pressing force of the order of 4.9 N to 6.9 N is sufficient, but for a single-package ink cartridge, which is an integrated ink cartridge for a plurality of colors, for example, for a six-color ink cartridge, seven needles are provided and thus a significantly great pressing force of 34.3 N to 48.3 N is required. Such a great pressing force is barely possible in the case of vertical mounting of an ink cartridge. Unfortunately, if the ink cartridge is required to be horizontally slid to be mounted, the ink jet printer would be strained, so such mounting is practically impossible.

Patent Document 1 describes an ink-cartridge attaching and detaching device that can obtain a great pressing force by leverage. That is, turning of a lever for attaching and detaching an ink cartridge is transmitted to a link plate, thus allowing a link lever to be unlocked and the ink cartridge to be mounted on a holder. Unfortunately, however, this device has been developed specifically for the mounting of ink cartridges, one for each color, so the device does not have a great force adaptable to a single-package ink cartridge, which is an integrated cartridge for a plurality of colors. In addition, the provision of a lever for attaching and detaching an ink cartridge and a link plate for each of ink cartridges leads to an increase in the number of parts and thus results in an increase in the cost of parts.

During and after being mounted, an ink cartridge receives from a channel member connected thereto a force for restoring the ink cartridge. As a result, unless the ink cartridge is mounted by a pressing force greater than that force and the state is maintained, a gap is generated between both, a contact on each of the ink cartridge and the channel member is misaligned, and the remaining amount of ink cannot be detected. Variations in tolerances of dimensions of parts also cause the misalignment of the contacts. Unfortunately, Patent Document 1 does not disclose an arrangement for ensuring such a great pressing force and an intimate contact state.

Additionally, as a flat-shape ink cartridge, as illustrated in FIG. 29, an attaching and detaching device 500 for mounting an ink cartridge 508 by latching both left and right sides of the ink cartridge 508 is known. Specifically, first, when the ink cartridge 508 is inserted in a direction indicated the arrow, latch projections 555*a* of a pair of left and right cartridge holding units 555 are moved toward the ink-cartridge side and engage with a pair of left and right depressions 508*a* of the ink cartridge 508. Then, an operation of turning a lever arm (not shown) presses the ink cartridge 508 by a predetermined stroke. In association therewith, ink supply needles 502 on a channel section 501 are pressed into needle insertion openings 508*b* of the ink cartridge 508, and mounting of the ink cartridge 508 is completed.

However, in order to smoothly insert the ink cartridge 508, an ink-cartridge insertion opening 556 needs to have a dimension that is slightly greater than the width of the ink cartridge 508. Therefore, unfortunately, the ink cartridge 508 may be mounted in a so-called one-side latch state, in which, because the ink cartridge 508 is obliquely inserted, only one of the depressions 508*a* and only one of the latch projections 555*a* are engaged with each other. In other words, incorrect mounting caused by incorrect insertion may happen. As a result, the ink supply needles 502 may incorrectly pierce the ink cartridge 508, and thus ink may leak out from these points.

[Patent Document 1] Japanese Unexamined Patent Application Publication No. 11-157094

DISCLOSURE OF THE INVENTION

Problems to be Solved by the Invention

In light of the above-mentioned circumstances, an object of the present invention is to provide an ink-cartridge attaching and detaching device that, even when a single-package ink cartridge, which is an integrated cartridge for a plurality of colors, that has a flat shape is used, can obtain a great pressing force by using a significantly small force, can reliably mount the ink cartridge without causing misalignment after mounting, and can easily remove the ink cartridge, and also provide a recording apparatus including the attaching and detaching device and a liquid ejecting apparatus including the attaching and detaching device.

Means for Solving the Problems

To attain the object, a first aspect of the present invention provides an ink-cartridge attaching and detaching device for sliding an ink cartridge and mounting the ink cartridge on a main body of a recording apparatus. The ink-cartridge attaching and detaching device includes a cartridge holding unit configured to hold the ink cartridge by insertion of the ink cartridge by a first predetermined stroke and a power transmitting and converting mechanism configured to ensure a pressing force required for mounting the ink cartridge by leverage by turning of a lever arm and to convert the turning of the lever arm into motion of a second predetermined stroke required for mounting the ink cartridge while held by the cartridge holding unit. The cartridge holding unit includes an integrated engagement member configured to engage with a surface of the ink cartridge, the surface being parallel to a mounting direction. When engaging with the ink cartridge, the engagement member lies in a central portion in a width direction with respect to the mounting direction at the surface.

The term "insertion of an ink cartridge" as used herein refers to a state in which the ink cartridge is inserted from the outside of a recording apparatus to the inside thereof and then the ink cartridge is held by a cartridge holding unit. The term "mounting of an ink cartridge" as used herein refers to a state in which the ink cartridge held by the cartridge holding unit is pressed together with the cartridge holding unit by turning of a lever and then a needle is embedded in the ink cartridge.

In order for the ink cartridge to be smoothly inserted into a main body of the recording apparatus, a certain amount of gap (clearance) is necessary between the ink cartridge and an insertion opening for allowing the ink cartridge to be inserted therefrom. Therefore, in known techniques, the ink cartridge may be inclined while being inserted. In addition, in known techniques, a plurality of cartridge holding units are provided so as to engage with a plurality of surfaces, for example, a pair of left and right cartridge holding units are provided so as to engage with both sides with the aim of mounting the ink cartridge properly, in other words, without inclining the ink cartridge. Unfortunately, however, there is a possibility that the ink cartridge might be inclined and this would cause only one side of the ink cartridge to be held and incorrect mounting of the ink cartridge.

Unused ink cartridges, i.e., heavy ink cartridges full of ink, are often mounted. In such cases, if an engagement member engages with a position remote from the center of gravity of an ink cartridge in a width direction perpendicular to the direction of insertion, a turning force may occur when the ink cartridge is mounted, and the ink cartridge may be inclined.

According to the first aspect of the present invention, the cartridge holding unit includes the integrated engagement member configured to engage with the surface of the ink cartridge, the surface being parallel to the mounting direction, and the engagement member lies in the central portion in the width direction with respect to the mounting direction at the surface when engaging with the ink cartridge. Therefore, even if the ink cartridge is inclined, the ink cartridge is not held at only one side of both left and right sides, unlike known techniques, and the cartridge holding unit can reliably hold the ink cartridge at the central portion in the width direction of the ink cartridge.

In addition, since the engagement member in the cartridge holding unit is formed integrally, an incomplete state, such as only one side being held, does not occur in the first place.

In accordance with a second aspect of the present invention, in the first aspect of the present invention, the engagement member includes a plurality of nail portions configured to engage with the ink cartridge, the nail portions being integral with the engagement member in the width direction with respect to the mounting direction.

According to the second aspect of the present invention, in addition to the operational advantages similar to those in the first aspect, the engagement member is formed integrally in the width direction with respect to the mounting direction, and the plurality of nail portions are included. Therefore, when engagement is attained by the plurality of locations, the movements of the plurality of nail portions can be synchronized accurately, so there is no possibility of occurrence of an incomplete state, such as only one side being held, as described above.

In addition, since engagement with the plurality of locations is attained by the plurality of locations, the attitude of the ink cartridge can be stabilized.

A third aspect of the present invention provides an ink-cartridge attaching and detaching device for sliding an ink cartridge and mounting the ink cartridge on a main body of a recording apparatus. The ink-cartridge attaching and detaching device includes a cartridge holding unit configured to hold the ink cartridge by insertion of the ink cartridge by a first predetermined stroke and a power transmitting and converting mechanism configured to ensure a pressing force required for mounting the ink cartridge by leverage by turning of a lever arm and to convert the turning of the lever arm into motion of a second predetermined stroke required for mounting the ink cartridge while held by the cartridge holding unit. The cartridge holding unit includes a slider configured to move in response to a power from the power transmitting and converting mechanism, an engagement member configured to engage with the slider, swing with respect to the slider, engage with the ink cartridge, hold the ink cartridge, and move in the mounting direction together with the slider, a first engagement unit configured to operate such that the slider and the engagement member directly engage with each other when the engagement member swings, and a second engagement unit configured to operate such that the slider and the engagement member directly engage with each other when the engagement member mounts the ink cartridge.

The term "directly engage" as used herein refers to engagement in which the slider and the engagement member are directly in contact with each other and engaged without the use of a shaft therebetween.

If a shaft used for swinging was provided, so-called clearance for swinging would be needed, resulting in rattling. As a result, the possibility arises that, when the engagement member swings, the positional accuracy of the engagement member will decrease. In addition, the possibility arises that, during movement of the cartridge holding unit and mounting of the ink cartridge, the load imposed on the engagement member engaging with the ink cartridge will be focused on the shaft and the shaft will be deformed. Therefore, the possibility arises that the positional accuracy of the engagement member will decrease and the second predetermined stroke will not be ensured.

According to the third aspect of the present invention, the cartridge holding unit includes the slider configured to move in response to the power from the power transmitting and converting mechanism, the engagement member configured to engage with the slider, swing with respect to the slider, engage with the ink cartridge, hold the ink cartridge, and move in the mounting direction together with the slider, the first engagement unit configured to operate such that the slider and the engagement member directly engage with each other when the engagement member swings, and the second engagement unit configured to operate such that the slider and the engagement member directly engage with each other when the engagement member mounts the ink cartridge. Therefore, during insertion and movement for mounting and dismounting, by changing the location of engagement and contact of the slider and the engagement member, the engagement member maintains a swinging function without the provision of a shaft used for swinging. As a result, compared with a case in which a shaft is provided, the positional accuracy of the engagement member when the engagement member swings can be improved. During mounting of the ink cartridge, direct engagement attained by the second engagement unit allows the engagement member to be accurately positioned. In addition, the second predetermined stroke can be reliably ensured.

In accordance with a fourth aspect of the present invention, in the third aspect of the present invention, the slider and the engagement member are configured to, when the ink cartridge is inserted by the first predetermined stroke, be engaged by the first engagement unit, configured to, when the ink cartridge is moved in the mounting direction by the second predetermined stroke, be engaged under the weight of the ink cartridge by the second engagement unit, and configured to, when the ink cartridge is moved in a dismounting direction, be engaged by the first engagement unit.

According to the fourth aspect of the present invention, in addition to the operational advantages similar to those in the third aspect, the slider and the engagement member are configured to, when the ink cartridge is inserted by the first predetermined stroke, be engaged by the first engagement unit, configured to, when the ink cartridge is moved in the mounting direction by the second predetermined stroke, be engaged under the weight of the ink cartridge by the second engagement unit, and configured to, when the ink cartridge is moved in the dismounting direction, be engaged by the first engagement unit. Therefore, the location of contact and engagement is changed by the operation and the action of the engagement member such that, when swinging of the engagement member causes engagement with the ink cartridge and release of the engagement, the engagement member is engaged by the first engagement unit, and, when the ink cartridge is pushed and mounted, the engagement member is engaged by the second engagement unit. Engagement is switched from the first engagement unit to the second engagement unit by the weight of the ink cartridge. Therefore, it is not necessary to provide an additional power source for switching.

In accordance with a fifth aspect of the present invention, in the fourth aspect of the present invention, the cartridge holding unit includes an urging unit. The urging unit is configured to, when a force generated by the weight of the ink cartridge is not exerted during moving of the ink cartridge in the mounting direction, urge the engagement member such that the engagement member is engaged by the first engagement unit.

According to the fifth aspect of the present invention, in addition to the operational advantages similar to those in the fourth aspect, the cartridge holding unit includes the urging unit, and the urging unit is configured to, when the weight of the ink cartridge is not exerted during moving of the ink cartridge in the mounting direction, urge the engagement member such that the engagement member is engaged by the first engagement unit. Therefore, when the force generated by the weight of the ink cartridge is not exerted, the urging unit can switch from an engagement state attained by the second engagement unit to an engagement state attained by the first engagement unit. When the above-described force is not exerted, the engagement member can swing accurately, and the engagement with ink cartridge can be easily attained or released.

In accordance with a sixth aspect of the present invention, in any one of the third to fifth aspects of the present invention, the second engagement unit includes a slider projection provided at the slider and extending in a direction in which the engagement member swings and a slit portion provided in the engagement member, extending in the mounting direction, and allowing the slider projection to pass therethrough.

According to the sixth aspect of the present invention, in addition to the operational advantages similar to those in any one of the third to fifth aspects, the second engagement unit includes the slider projection provided at the slider and extending in a direction in which the engagement member swings and the slit portion provided in the engagement member, extending in the mounting direction, and allowing the slider projection to pass therethrough. Therefore, the first engagement unit can be constructed by a simple structure.

In accordance with a seventh aspect of the present invention, in any one of the third to sixth aspects of the present invention, the cartridge holding unit includes a cartridge unlocking unit configured to, during moving of the ink cartridge from a state of being mounted to a direction in which the ink cartridge is to be dismounted, unlock engagement of the engagement member and the ink cartridge.

According to the seventh aspect of the present invention, in addition to the operational advantages similar to those in any one of the third to sixth aspects, the cartridge unlocking unit configured to unlock engagement of the engagement member and the ink cartridge is included. Therefore, during moving of the ink cartridge from a state of being mounted to the dismounting direction, the engagement of the engagement member and the ink cartridge can be released by the cartridge unlocking unit, a state in which the ink cartridge is held by the cartridge holding unit can be released, and the ink cartridge can be removed.

In accordance with an eighth aspect of the present invention, in the seventh aspect of the present invention, the cartridge unlocking unit is configured to, during moving of the ink cartridge in the dismounting direction, urge the engagement member such that the engagement member is engaged with the slider by the first engagement unit and cause the engagement member to swing.

According to the eighth aspect of the present invention, in addition to the operational advantages similar to those in the seventh aspect, the cartridge unlocking unit is configured to, during moving of the ink cartridge in the dismounting direction, urge the engagement member such that the engagement member is engaged with the slider by the first engagement unit and cause the engagement member to swing. Therefore, the cartridge unlocking unit can cause the engagement member to accurately swing when the engagement of the engagement member and the ink cartridge is released. That is, there is no possibility that unstable path of swinging of the engagement member will prevent engagement of the engagement member and the ink cartridge from being released.

In accordance with a ninth aspect of the present invention, in the seventh or eighth aspect of the present invention, the cartridge unlocking unit is configured to, during mounting of the ink cartridge, urge the engagement member such that the engagement member is engaged with the slider by the second engagement unit.

According to the ninth aspect of the present invention, the cartridge unlocking unit is configured to, during mounting of the ink cartridge, urge the engagement member such that the engagement member is engaged with the slider by the second engagement unit. Therefore, during mounting of the ink cartridge, the attitude of the engagement member can be stabilized, and the positional accuracy of the engagement member can be further improved.

In accordance with a tenth aspect of the present invention, in any one of the third to ninth aspects of the present invention, the first engagement unit is configured such that, during swinging of the engagement member and releasing of a state of holding the ink cartridge, in order to facilitate releasing engagement of the engagement member and the ink cartridge, a radius of swinging varies with swinging of the engagement member by swinging the engagement member while moving the engagement member with respect to the slider.

According to the tenth aspect of the present invention, in addition to the operational advantages similar to those in any one of the third to ninth aspects, the first engagement unit is configured such that, during swinging of the engagement member and releasing of a state of holding the ink cartridge, in order to facilitate releasing engagement of the engagement member and the ink cartridge, the radius of swinging varies with swinging of the engagement member by swinging the engagement member while moving the engagement member with respect to the slider. Therefore, the possibility of occurrence of friction between the engagement member and the ink cartridge can be reduced, and the engagement of the engagement member and the ink cartridge can be easily released.

An eleventh aspect of the present invention provides a recording apparatus including an ink-cartridge attaching and detaching device for sliding an ink cartridge and mounting the ink cartridge on a main body of the recording apparatus, the ink-cartridge attaching and detaching device being an ink-cartridge attaching and detaching device according to any one of the first to tenth aspects.

According to the eleventh aspect of the present invention, since the recording apparatus includes the attaching and detaching device according to any one of the first to tenth aspects, in the recording apparatus, the operational advantages similar to those in any one of the first to tenth aspects can be obtained.

A twelfth aspect of the present invention provides a liquid ejecting apparatus including a liquid-cartridge attaching and detaching device for sliding a liquid cartridge and mounting the liquid cartridge on a main body of the liquid ejecting apparatus. The liquid ejecting apparatus includes a cartridge holding unit configured to hold the liquid cartridge by insertion of the liquid cartridge by a first predetermined stroke and a power transmitting and converting mechanism configured to ensure a pressing force required for mounting the liquid cartridge by leverage by turning of a lever arm and to convert the turning of the lever arm into motion of a second predetermined stroke required for mounting the liquid cartridge while held by the cartridge holding unit. The cartridge holding unit includes an integrated engagement member configured to engage with a surface of the liquid cartridge, the surface being parallel to a mounting direction. When engaging with the liquid cartridge, the engagement member lies in a central portion in a width direction with respect to the mounting direction at the surface.

A thirteenth aspect of the present invention provides a liquid ejecting apparatus including a liquid-cartridge attaching and detaching device for sliding a liquid cartridge and mounting the liquid cartridge on a main body of the liquid ejecting apparatus. The liquid ejecting apparatus includes a cartridge holding unit configured to hold the liquid cartridge by insertion of the liquid cartridge by a first predetermined stroke and a power transmitting and converting mechanism configured to ensure a pressing force required for mounting the liquid cartridge by leverage by turning of a lever arm and to convert the turning of the lever arm into motion of a second predetermined stroke required for mounting the liquid cartridge while held by the cartridge holding unit. The cartridge holding unit includes a slider configured to move in response to a power from the power transmitting and converting mechanism, an engagement member configured to engage with the slider, swing with respect to the slider, engage with the liquid cartridge, hold the liquid cartridge, and move in the mounting direction together with the slider, a first engagement unit configured to operate such that the slider and the engagement member directly engage with each other when the engagement member swings, and a second engagement unit configured to operate such that the slider and the engagement member directly engage with each other when the engagement member mounts the liquid cartridge.

DETAILED DESCRIPTION OF THE INVENTION

Figure 1:
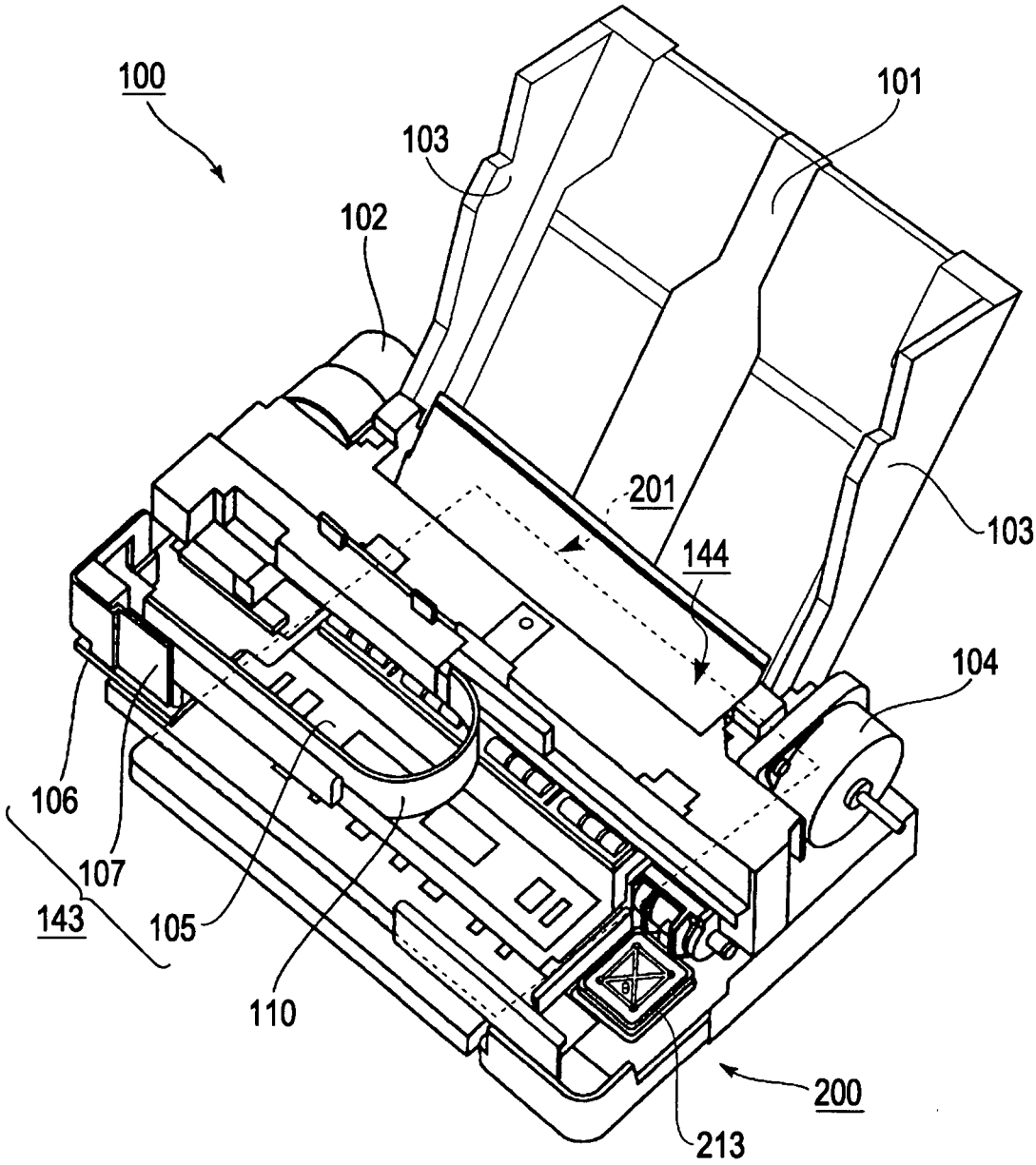
FIG. 1 is a general perspective view schematically showing a recording apparatus according to the present invention.

Embodiments of the present invention will now be described with reference to the drawings.

A hopper 101 for accommodating stacked sheets of paper as recording media is disposed at the rear of a main body of a recording apparatus 100 so as to be swingable about an upper section as a fulcrum. A top sheet stacked on the hopper 101 is fed to a recording-portion side, which is a downstream side of the transport direction, by a feeding portion 144. Specifically, one of stacked sheets is picked up by a feeding roller (not shown) driven by a feeding motor 104, guided by a paper guide 103, and fed to a transport roller (not shown), which is disposed downstream in the transport direction. The sheet fed to the transport roller is further transported to a recording portion 143, which is disposed downstream in the transport direction, by the transport roller driven by a transport motor (not shown). The recording portion 143 includes a platen 105 for supporting paper from below and a carriage 107 disposed above the platen 105 so as to face the platen 105. The carriage 107 is driven by a carriage motor 102 while being guided by a carriage guide shaft (not shown) extending along the direction of main scan. A recording head 106 for ejecting ink toward paper is disposed on a bottom of the carriage 107. The sheet recorded by the recording portion 143 is further transported downstream and output by an output roller (not shown) from the front side of the recording apparatus 100.

Figure 7:
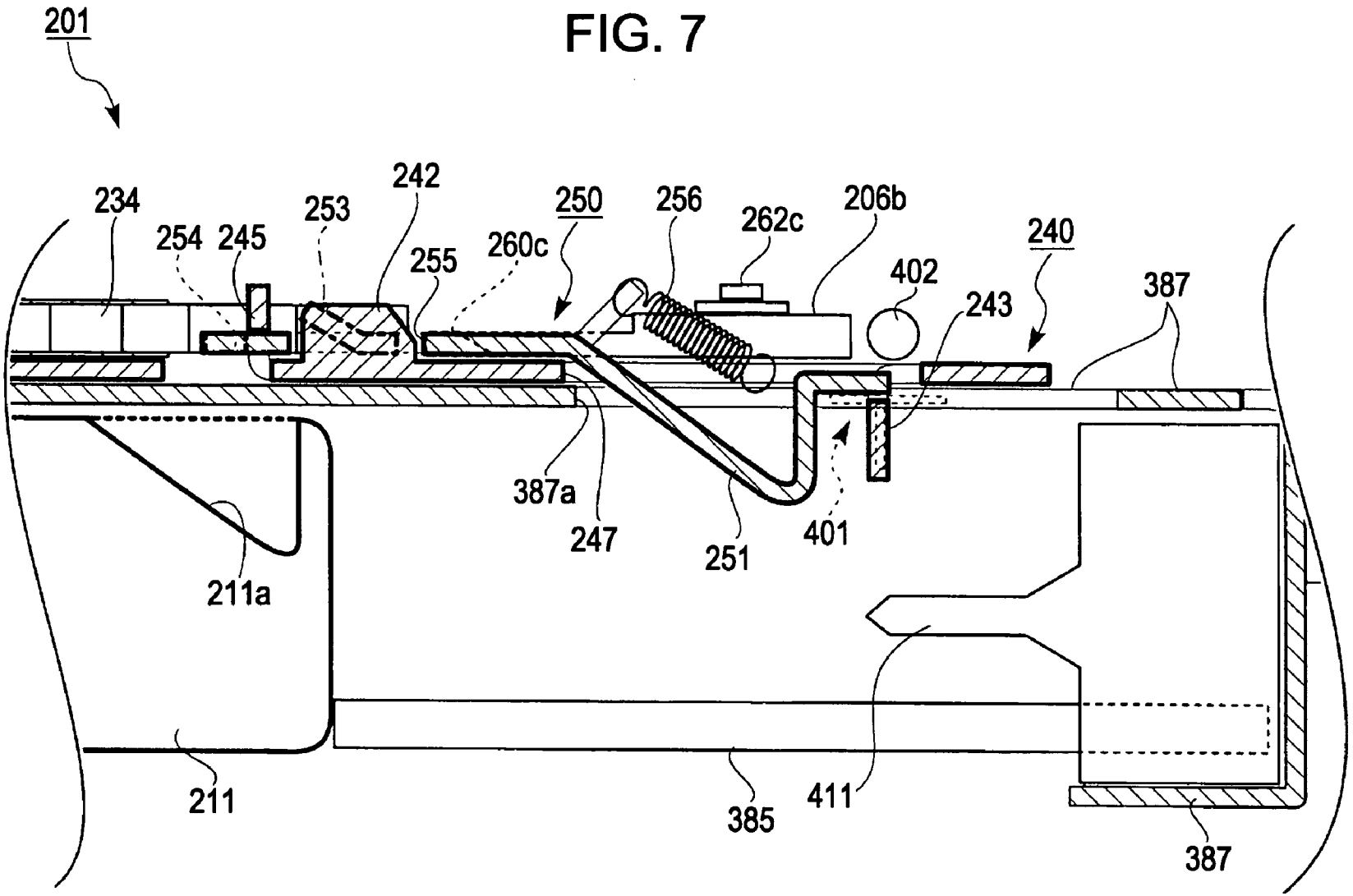
FIG. 7 is a sectional side view of an essential part of the attaching and detaching device when the lever arm is in the reset position in the course of insertion.

An ink cartridge 211 (see FIG. 3) is mounted on an attaching and detaching device 201 disposed on a lower portion of the main body of the recording apparatus 100, and ink is supplied to an ink channel (not shown) via an ink supply needle 411 (see FIG. 7). The ink is supplied to the recording head 106 on the carriage 107 via an ink supply tube 110. During flushing and cleaning of the recording head 106, an ink suction device 200, acting as an ejection-characteristics maintaining portion for maintaining ejection characteristics of the recording portion 143, disposed at a LSD side performs an operation of ejecting and sucking ink. The ink suction device 200 includes a cap portion 213. The ink suction device 200 can seal the recording head 106 by vertically moving the cap portion 213.

Figure 2:
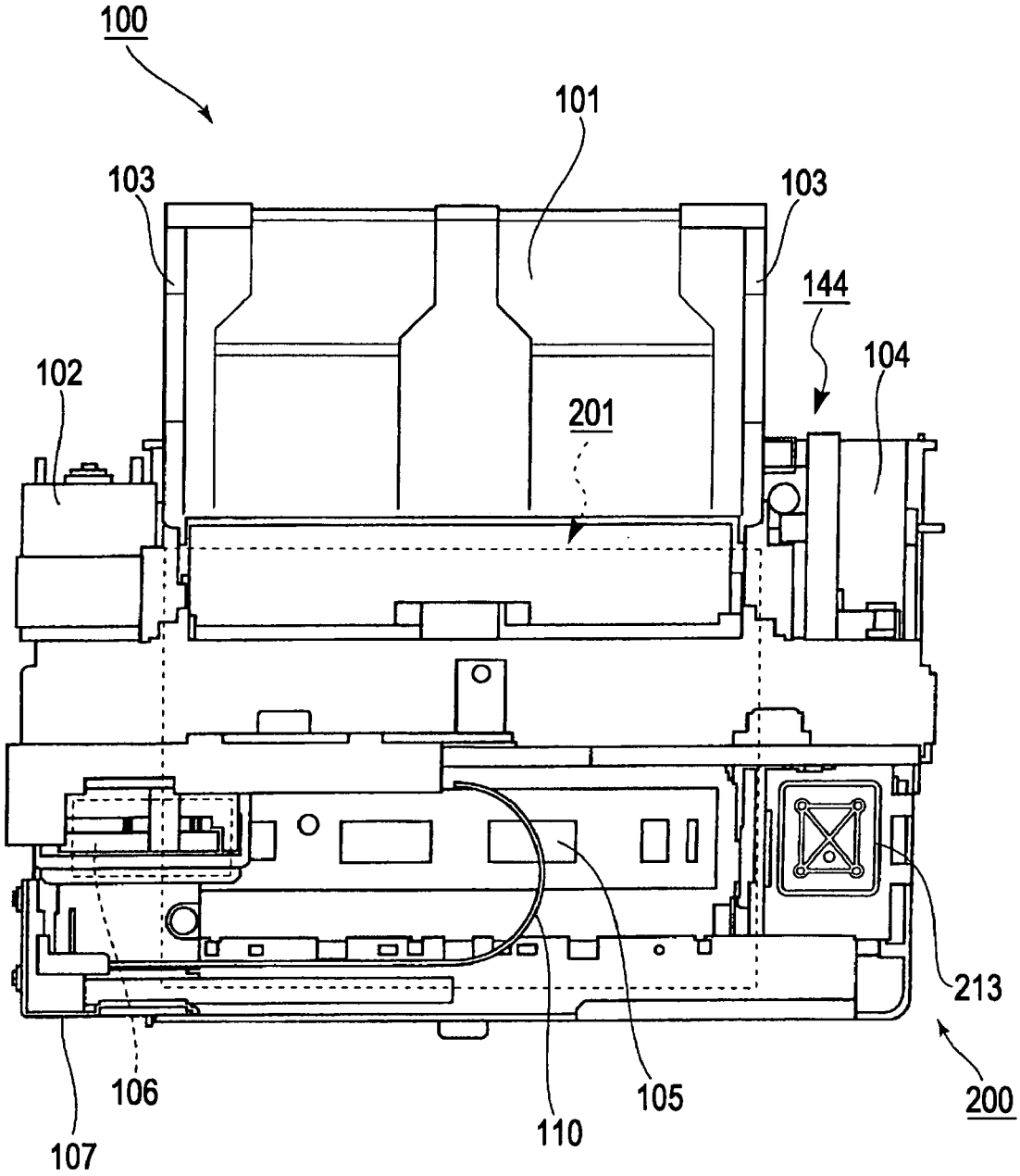
FIG. 2 is a general plan view schematically showing the recording apparatus according to the present invention.
Figure 3:
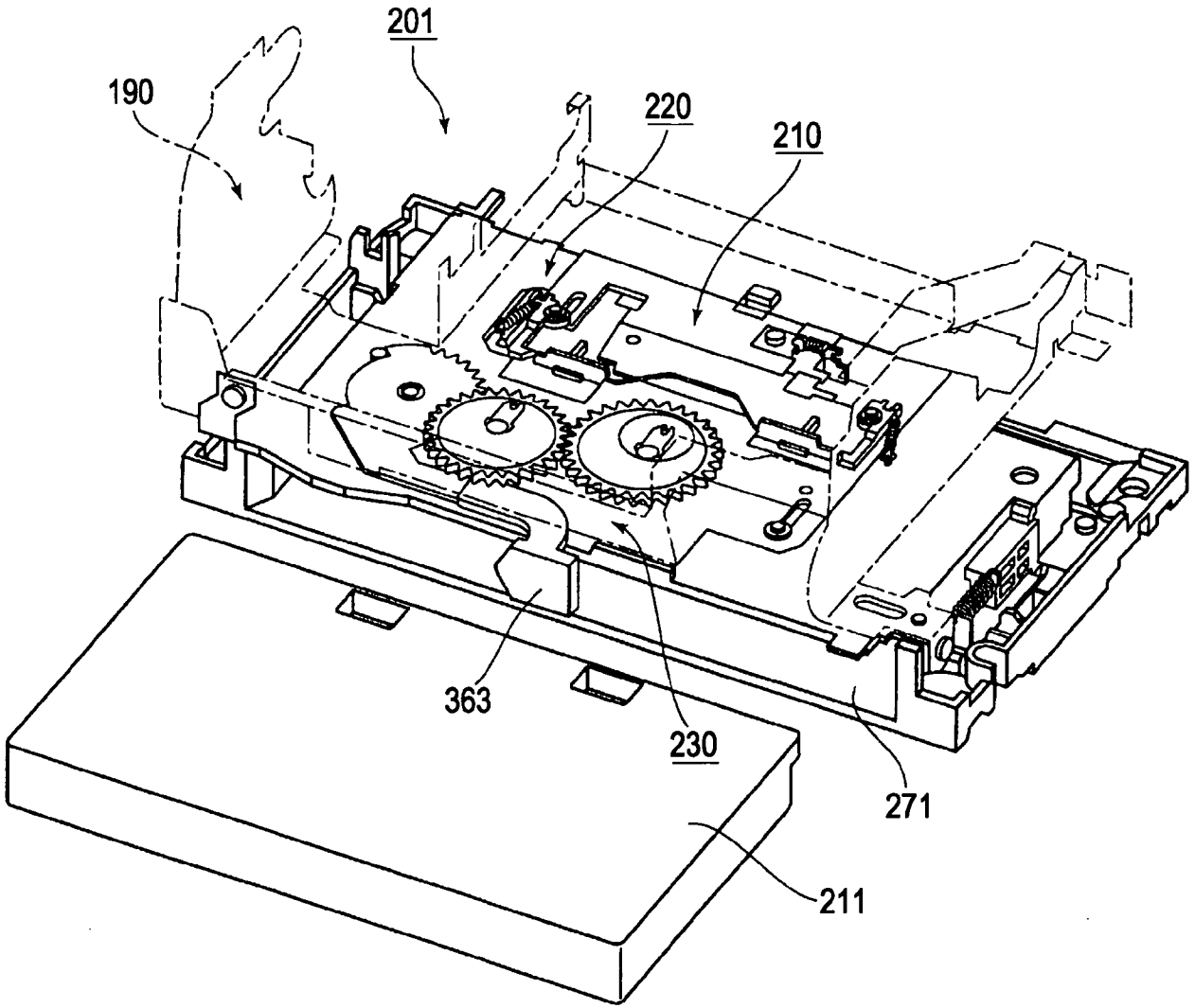
FIG. 3 is a general perspective view schematically showing an attaching and detaching device according to the present invention.

As shown in FIG. 3, the attaching and detaching device 201 includes an insertion opening 271 for allowing the ink cartridge 211 to be inserted therefrom. The insertion opening 271 is disposed at the back of the recording apparatus 100 illustrated in FIGS. 1 and 2. The attaching and detaching device 201 for an ink cartridge includes a lever arm 363 operated by a user, a power transmitting and converting mechanism 230 for converting a power of the lever arm 363 into motion of a second predetermined stroke S2 (see FIG. 11) required for mounting the ink cartridge 211, a cartridge holding unit 210 configured to hold the ink cartridge 211 that has been inserted by a first predetermined stroke S1 (see FIG. 8) in the insertion opening 271, and a cartridge unlocking unit 220 configured to release a state in which the ink cartridge 211 is held by the cartridge holding unit 210 during dismounting of the ink cartridge 211. The structure and operation of these elements is described below in sequence.

A frame member 190 for arranging a transport portion configured to transport paper and the recording portion configured to record information on paper is disposed above the attaching and detaching device 201. The frame member 190 is formed of a metal plate. The frame member 190 is disposed so as to engage with a position that does not face the ink cartridge 211, i.e., a position on a sidewall surface adjacent to a side end of the attaching and detaching device 201 in a state where the ink cartridge 211 is mounted in the attaching and detaching device 201. This can avoid deformation of the attaching and detaching device 201 caused by the weight pressed and imposed on the frame member 190 and avoid an increase in friction between the attaching and detaching device 201 and the ink cartridge 211 when the ink cartridge 211 is inserted, mounted, or dismounted.

The engagement of the frame member 190 with other structures disposed above the frame member 190 can be removed from the side. The frame member 190 and the attaching and detaching device 201 disposed below the frame member 190 can be singly removed. In other words, only the attaching and detaching device 201 can be readily removed from the entire recording apparatus.

Figure 4:
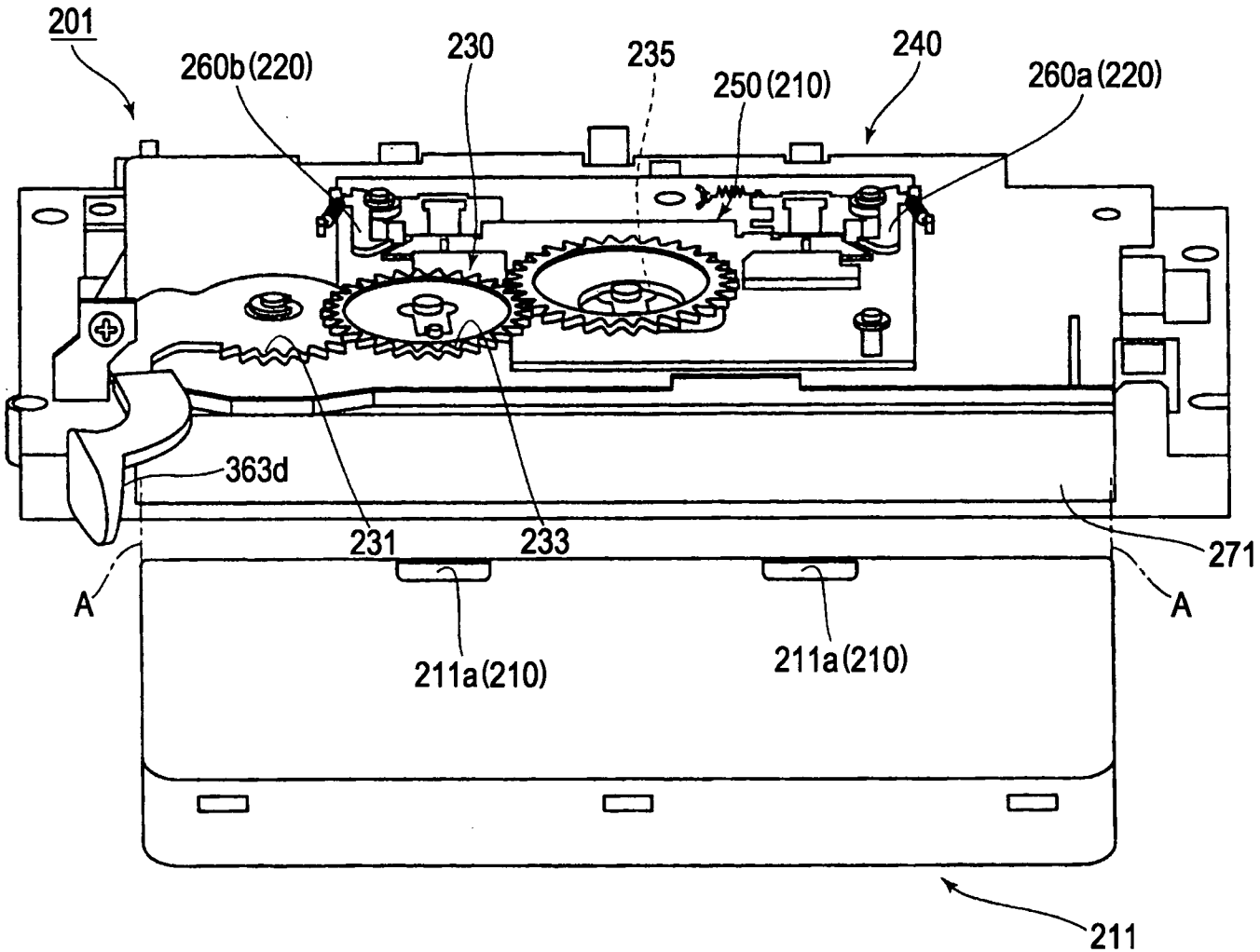
FIG. 4 is a front perspective view of the attaching and detaching device when a lever arm is in a reset position before insertion.
Figure 5:
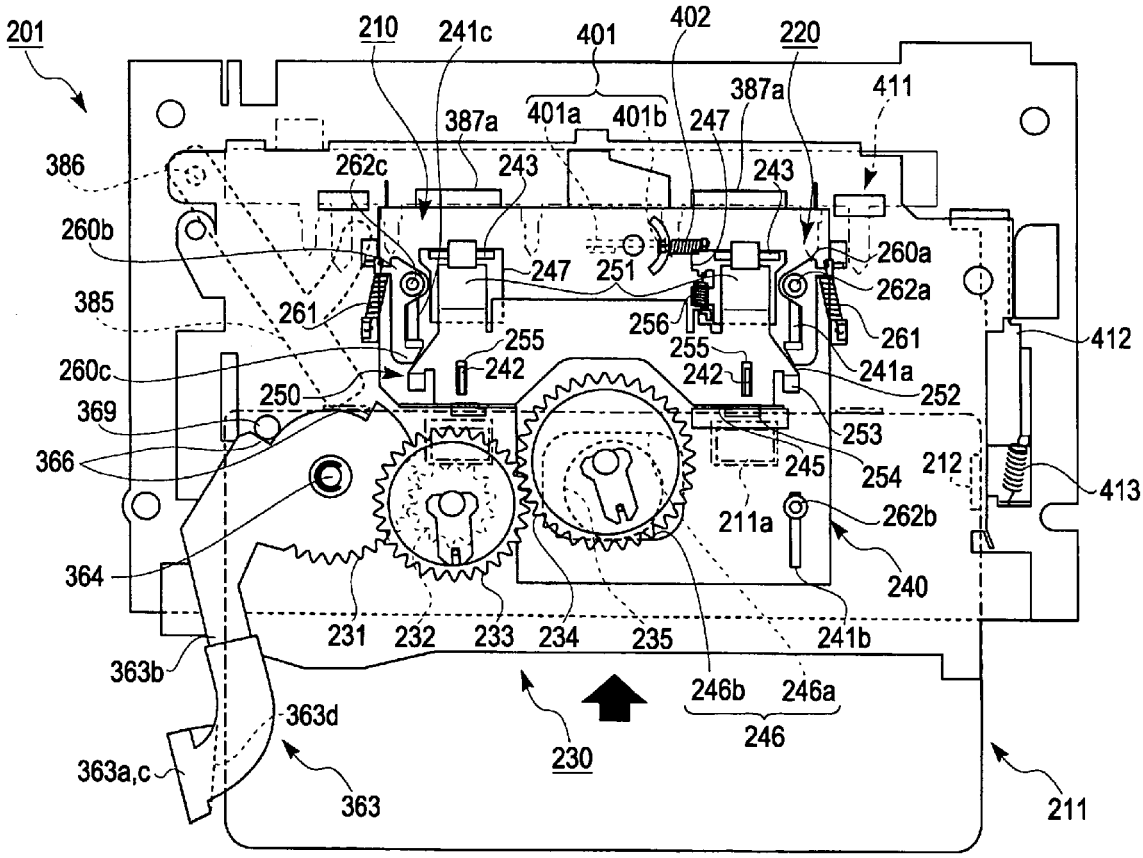
FIG. 5 is a plan view of the attaching and detaching device when the lever arm is in the reset position in the course of insertion.
Figure 6:
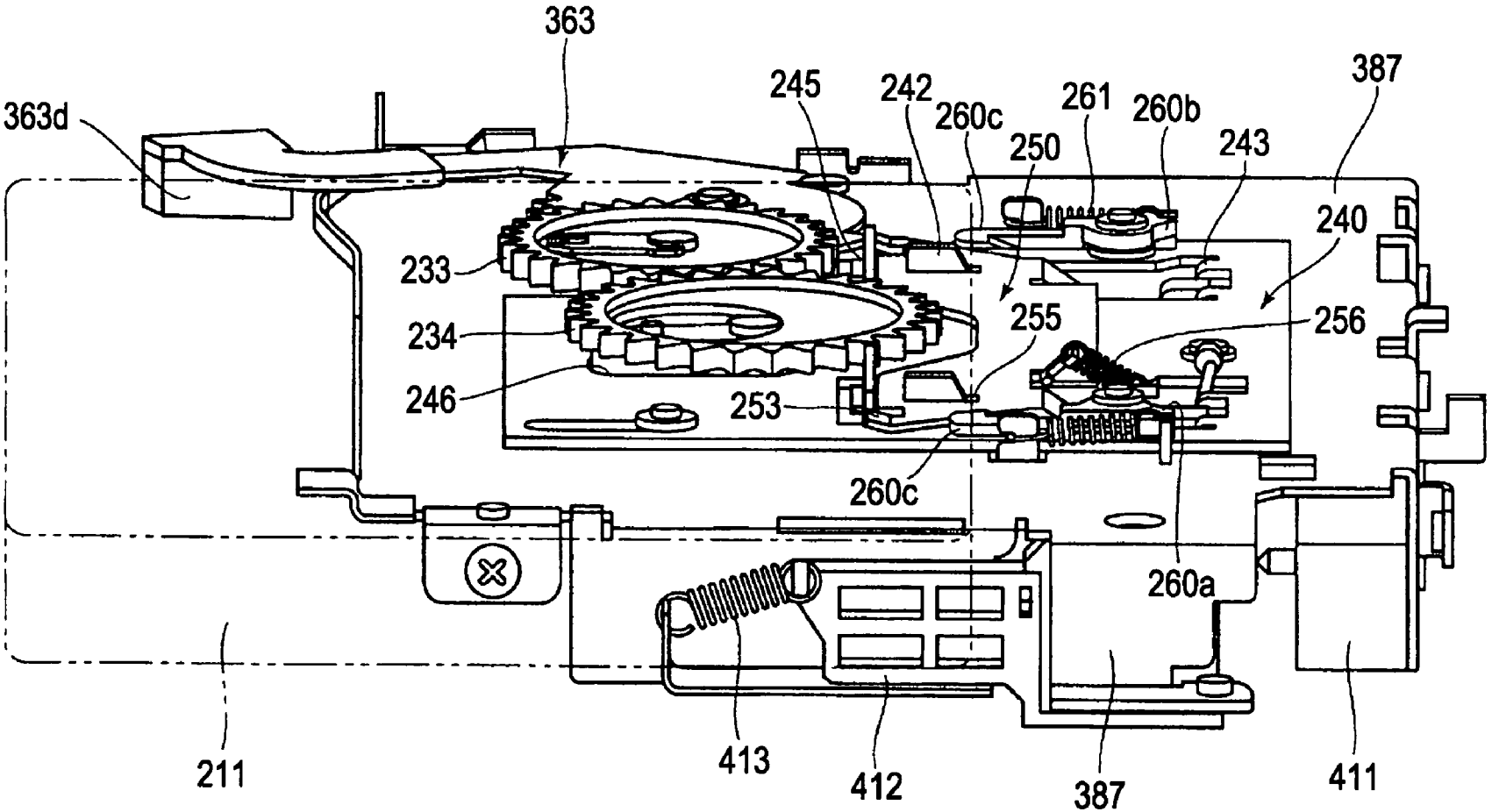
FIG. 6 is a side perspective view of the attaching and detaching device when the lever arm is in the reset position in the course of insertion.

FIG. 4 is a front perspective view illustrating the attaching and detaching device when a lever arm is in a "reset position" before the ink cartridge is inserted. FIG. 5 is a plan view of the attaching and detaching device when the lever arm is in the "reset position" in the course of insertion of the ink cartridge. FIG. 6 is a side perspective view of the attaching and detaching device shown in FIG. 5. FIG. 7 is a sectional side view of an essential part of the attaching and detaching device shown in FIG. 5.

As illustrated in FIGS. 4 to 7, the attaching and detaching device 201 for the ink cartridge 211 includes the power transmitting and converting mechanism 230, the cartridge holding unit 210, and the cartridge unlocking unit 220.

The power transmitting and converting mechanism 230 includes the lever arm 363, a first gear 231 formed in the lever arm 363, a second gear 232 being in contact with the first gear 231 so as to be capable of transmitting a power, a third gear 233 formed integrally with the second gear 232, a fourth gear 234 being in contact with the third gear 233 so as to be capable of transmitting a power, a cam portion 235 formed integrally with the fourth gear 234, and a slider 240 functioning as a cam follower being in contact with the cam portion 235. The slider 240 has a first slider opening portion 246. The slider 240 is movable in mounting and dismounting directions by causing the cam portion 235 to come into contact with and press a first surface 246*a* or a second surface 246*b*. The cam portion 235 has an eccentric cam portion 235*a* and a concentric cam portion 235*b*, which will be described below (see FIGS. 25(A) and 25(B)).

The direction of movement of the slider 240 is regulated by passing of shafts 262*a* and 262*b* through two guide slits 241*a* and 241*b* provided in the slider 240 along the movement direction.

In this embodiment, the lever arm 363 is provided so as to turn about a lever shaft 364 as a fulcrum. A position of the lever arm 363 shown in FIGS. 4 to 10 is referred to as the "reset position" of the lever arm. A position of the lever arm 363 shown in FIGS. 13 to 16 is referred to as the "set position" of the lever arm. The range of turning of the lever arm 363 is regulated by a lever turn regulation projection 369 provided on a base 387 of the main body of the attaching and detaching device 201 and two lever turn regulation portions 366 provided on the lever arm 363. Therefore, the lever arm 363 can turn only a range of from the "set position" to the "reset position".

The cartridge holding unit 210 is composed of the slider 240 disposed at the attaching and detaching device 201 and two depressions 211*a* disposed at the ink cartridge. The slider 240 is provided with a latch plate 250 having two nail portions 251. The depressions 211*a* can engage with the nail portions 251. The latch plate 250 is constructed such that the nail-portion side can swing in vertical directions shown in FIG. 7 with respect to the slider 240 about a position, as a fulcrum, where latch-plate engagement portions 254, which are disposed opposite to the nail portions 251, engage with slider engagement portions 245 disposed at the slider 240. The latch plate 250 is disposed at the upper surface of the slider 240. The two nail portions 251 of the latch plate 250 protrude downward through second slider opening portions 247 of the slider 240. The base 387 of the attaching and detaching device 201 also has base openings 387*a* such that the base openings 387*a* does not interfere with engagement of the nail portions 251 and the depressions 211*a*.

The slider 240 has the slider engagement portions 245 formed by bending at its central part in the mounting direction. The slider engagement portions 245 can engage with the respective latch-plate engagement portions 254 of the latch plate 250 disposed upstream in the mounting direction. In the present invention, each of the slider engagement portions 245 and each of the latch-plate engagement portions 254 constitute a first engagement unit. The latch plate 250 can swing about a position, as a fulcrum, of engagement of the first engagement unit.

In the present invention, the "engagement of the first engagement unit" refers to a state in which the slider engagement portion 245 and the latch-plate engagement portion 254 are in surface contact with each other.

The slider 240 has slider projections 242. The slider projections 242 are formed by bending in a direction perpendicular to the mounting direction so as to extend along the mounting direction and the direction of swinging of the latch plate 250. Each of the slider projections 242 can engage with a latch-plate slit 255 provided in the latch plate 250 and extending in the mounting direction. In the present invention, the slider projection 242 and the latch-plate slit 255 constitute a second engagement unit. When no external force is exerted on the latch plate 250, a latch-plate spring 256 urges the latch plate 250 such that the latch plate 250 and the slider 240 engage with each other and downwardly urges the nail portions 251 of the latch plate 250.

Figure 28:
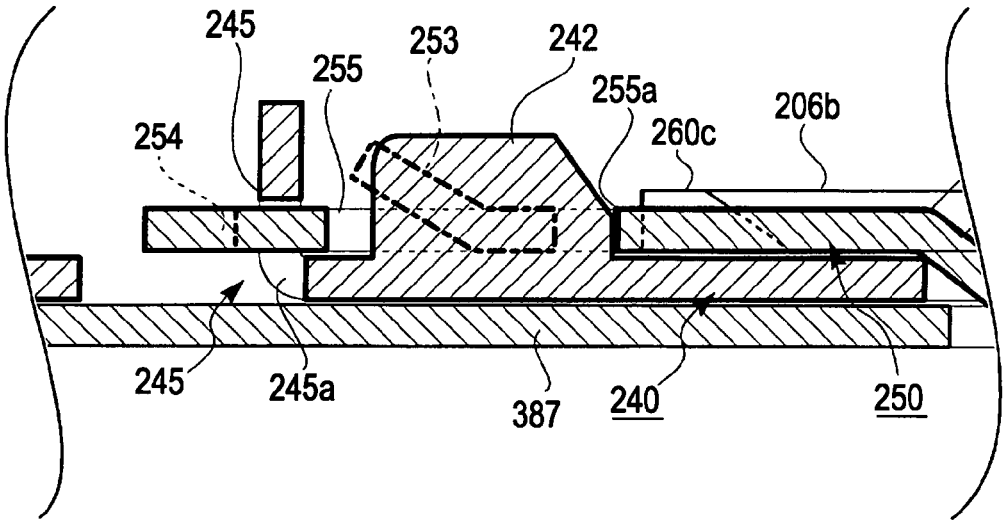
FIG. 28(A) and FIG. 28(B) are an enlarged sectional side view of an essential part and a plan view thereof, respectively, during engagement of a second engagement unit.
Figure 28:
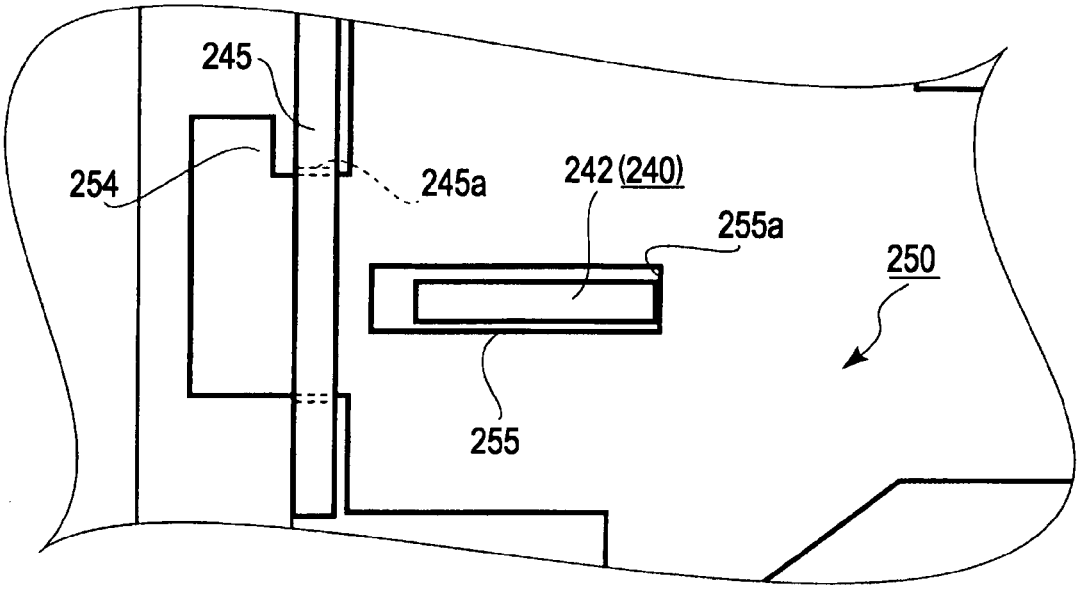

In the present invention, "engagement of the second engagement unit" refers to a state in which the slider projection 242 is in surface contact with a mounting-direction surface 255*a* of the latch-plate slit 255 (see FIG. 28) by pressing the mounting-direction surface 255*a*.

Moreover, the cartridge unlocking unit 220 is constituted of each of oblique portions 253 and each of cancelling arms 260*a* and 260*b*. The cancelling arms 260*a* and 260*b* are disposed on both sides of the latch plate 250 in a width direction with respect to the mounting direction. The cancelling arms 260*a* and 260*b* come into contact with the oblique portions 253 and upwardly push the latch plate 250 only when the ink cartridge 211 is dismounted.

The cancelling arms 260*a* and 260*b* can turn about the shaft 262*a* and a shaft 262*c* as a fulcrum, against an urging force of cancelling-arm springs 261, respectively.

The structure is described in greater detail below with reference to the operation of the attaching and detaching device 201.

In this embodiment, since each of the slider 240 and the latch plate 250 is formed of a metal plate, the latch plate 250 can be positioned accurately. Additionally, even if the device is left under high temperatures, there is no possibility of deformation.

[Insertion of Ink Cartridge]

The operation is described below for each state of insertion, mounting, and dismounting of the ink cartridge 211.

First, the ink cartridge 211 shown in FIG. 4 is inserted from the outside of the attaching and detaching device 201 into the insertion opening 271. At this time, a lever projection 363*c* of a knob 363*a* at a distal end of an arm body 363*b* of the lever arm 363 is provided with a guide surface 363*d*. The guide surface 363*d* is configured to guide the ink cartridge 211 to the insertion opening 271 when the ink cartridge 211 is inserted into the insertion opening 271 by a user. Specifically, the guide surface 363*d* is inclined with respect to the insertion direction of the ink cartridge 211 so as to gradually push the ink cartridge 211 deviating from an approach path "A" extending from the insertion opening 271 in the opposite direction back to the approach path A as the ink cartridge 211 approaches the insertion opening 271.

The term "mounting direction" as used herein refers to a direction in which the ink cartridge 211 enters the insertion opening 271 and heads for the ink supply needle 411, which is disposed at the back. Specifically, it is a direction from the lower side to the upper side in FIG. 5, which is indicated by the arrow.

When a leading end of the ink cartridge 211 is inserted into the insertion opening 271, the leading end of the ink cartridge 211 abuts a dismounting lever 385 disposed in the back of the insertion opening 271. The dismounting lever 385 is provided so as to urge the ink cartridge 211 in a dismounting direction by turning about a dismounting lever shaft 386 as a fulcrum by a spring (not shown).

The term "dismounting direction" as used herein refers to a direction opposite to the mounting direction.

A state in which the ink cartridge 211 stops after abutting the dismounting lever 385 is illustrated in FIGS. 5 to 7. In this state, since the course of the lever projection 363*c* is blocked by the side of the ink cartridge 211, it is impossible to turn the lever arm 363 in the "reset position" toward the "set position" side. This can avoid a user from performing an operation of pushing the ink cartridge 211 in the mounting direction by means of the lever projection 363*c*, a so-called erroneous operation (abnormal operation).

Figure 8:
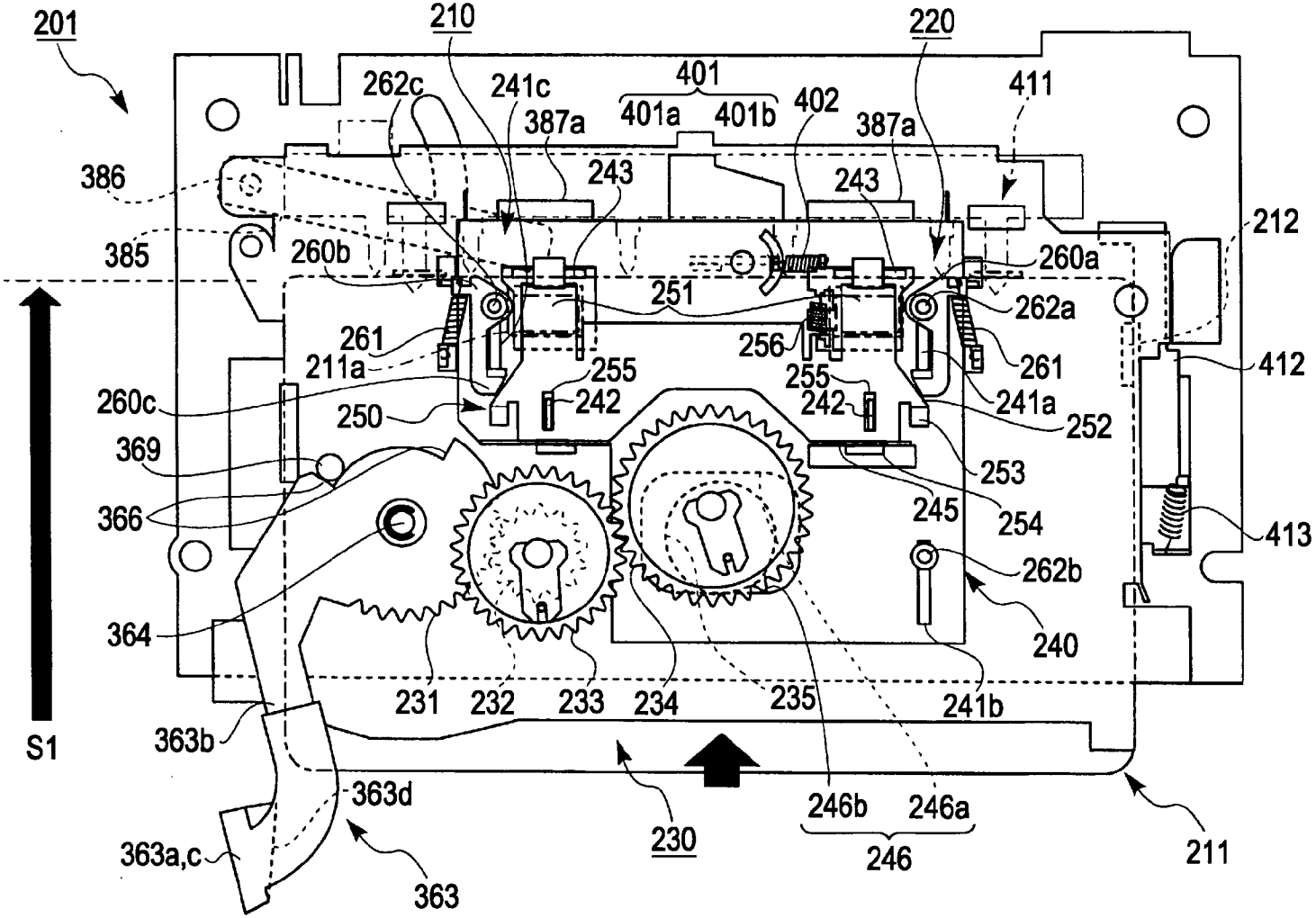
FIG. 8 is a plan view of the attaching and detaching device when the lever arm is in the reset position at completion of insertion.
Figure 9:
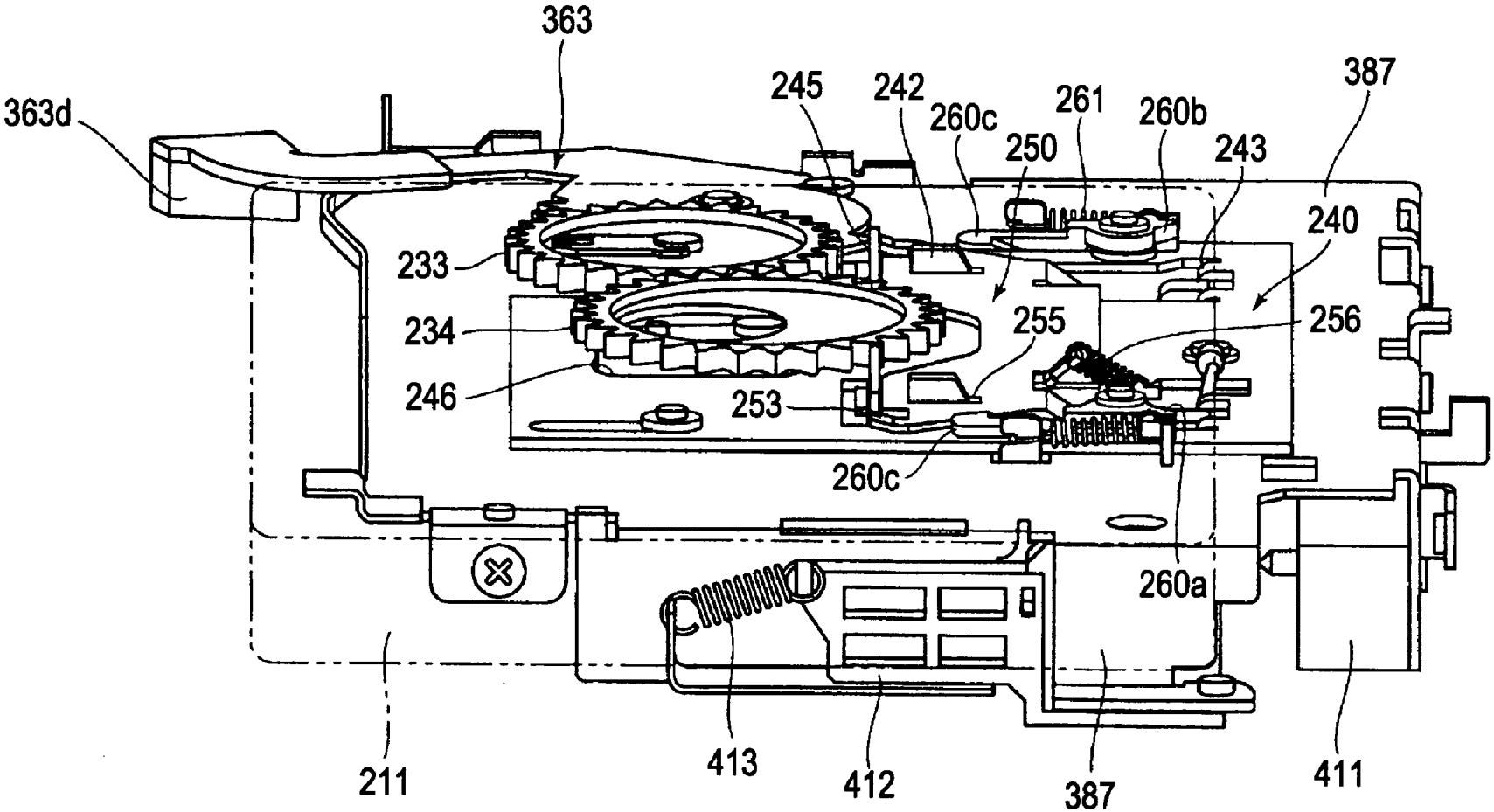
FIG. 9 is a side perspective view of the attaching and detaching device when the lever arm is in the reset position at completion of insertion.

FIG. 8 is a plan view of the attaching and detaching device when the lever arm is in the reset position at completion of insertion of the ink cartridge. FIG. 9 is a side perspective view of the attaching and detaching device shown in FIG. 8. FIG.

10 is a sectional side view of an essential part of the attaching and detaching device shown in FIG. 8.

Figure 10:
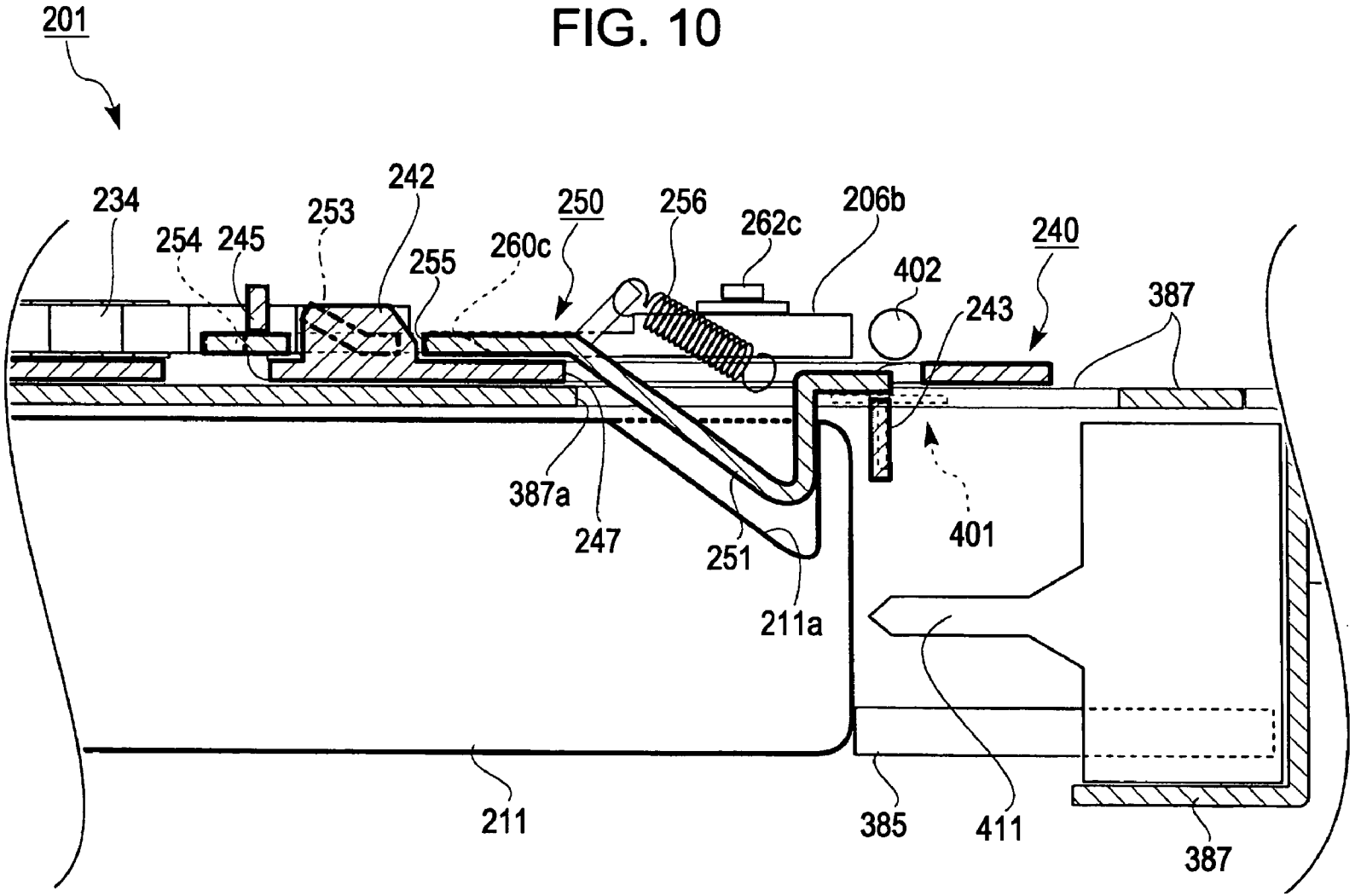
FIG. 10 is a sectional side view of an essential part of the attaching and detaching device when the lever arm is in the reset position at completion of insertion.

When, from a state shown in FIGS. 5 to 7, the ink cartridge 211 is further pushed against an urging force of the dismounting lever 385 and inserted by a first predetermined stroke S1, the insertion of the ink cartridge 211 is completed, as shown in FIGS. 8 to 10.

Specifically, when, from a state shown in FIGS. 5 to 7, the ink cartridge 211 is further pushed, the leading end of the ink cartridge 211 comes into contact with the nail portions 251, which project downward through the second slider opening portions 247 of the slider 240. Then, the leading end of the ink cartridge 211 upwardly pushes the nail portions 251 against the urging force of the latch-plate spring 256, and the two nail portions 251 engage with the respective depressions 211*a* of the ink cartridge 211. That is, the slider 240 integrally holds the ink cartridge 211 via the latch plate 250. This is a state of completion of insertion of the ink cartridge 211.

The two nail portions 251 of the latch plate 250 are formed integrally with the latch plate 250. The two nail portions 251 of the latch plate 250 are configured to engage with the respective depressions 211*a*, which are disposed adjacent to the center of the ink cartridge 211 in the width direction with respect to the mounting direction. Therefore, even if the orientation of the ink cartridge 211 is inclined with respect to the mounting direction to some extent, the two nail portions 251 can engage with the two depressions 211*a*, respectively. In addition, since the two nail portions 251 are formed integrally and thus are synchronized, there is no possibility of a state in which only one of the nail portions 251 engages with one of the depressions 211*a* and the other one of the nail portions 251 does not engage with the other one of the depressions 211*a*, a so-called one-side latch state.

If a user attempts to further insert the ink cartridge 211 with hand toward the back side from a location of the ink cartridge 211 shown in FIGS. 8 to 10, the leading end of the ink cartridge 211 is regulated by abutment portions 243 provided at the slider 240. At this time, the slider 240 does not move due to the shape of the cam portion 235 (see FIGS. 25(A) and 25(B)) unless the lever arm 363 is turned.

[Mounting of Ink Cartridge]

Figure 11:
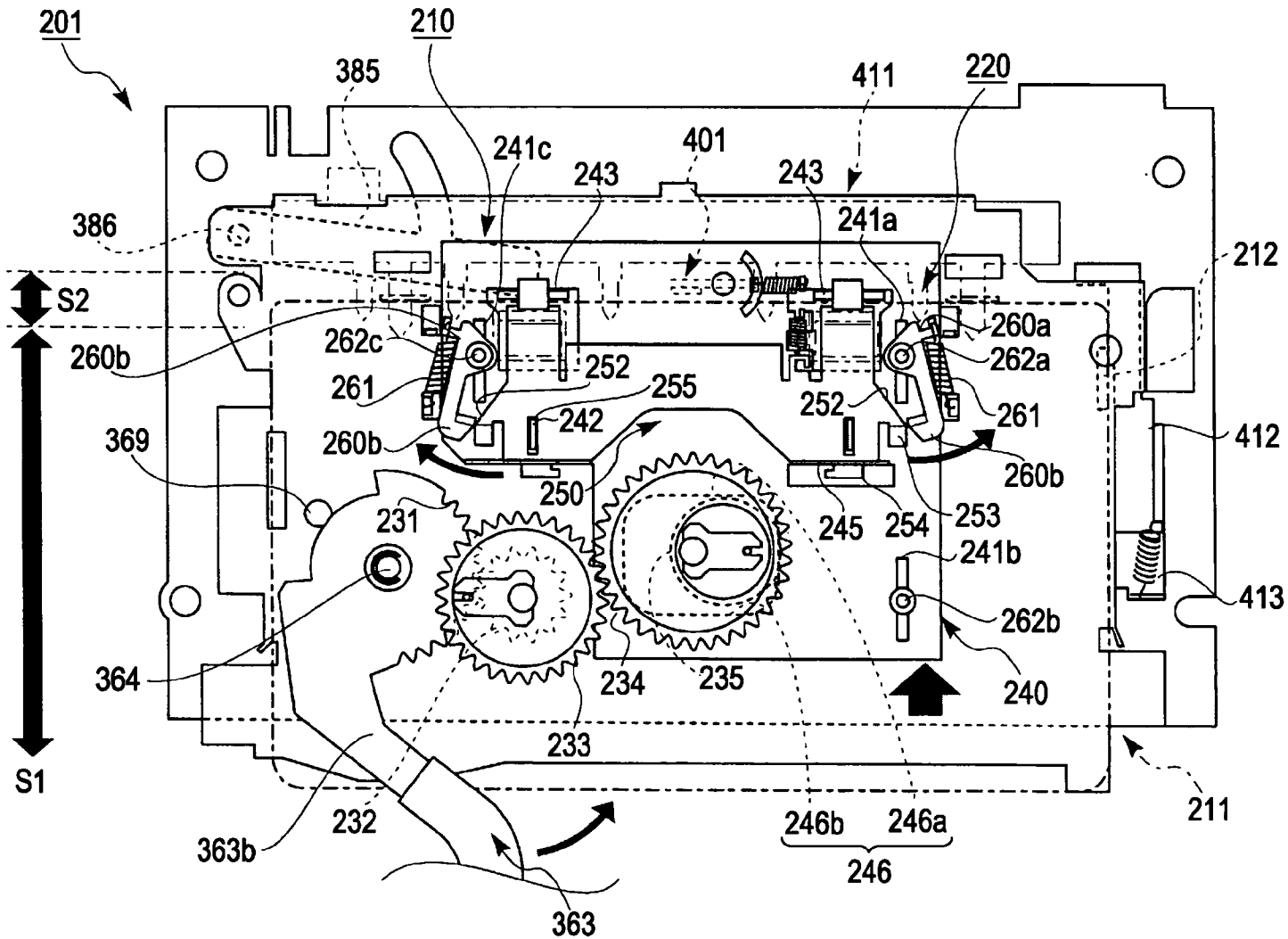
FIG. 11 is a plan view of the attaching and detaching device in the course of mounting of an ink cartridge.
Figure 12:
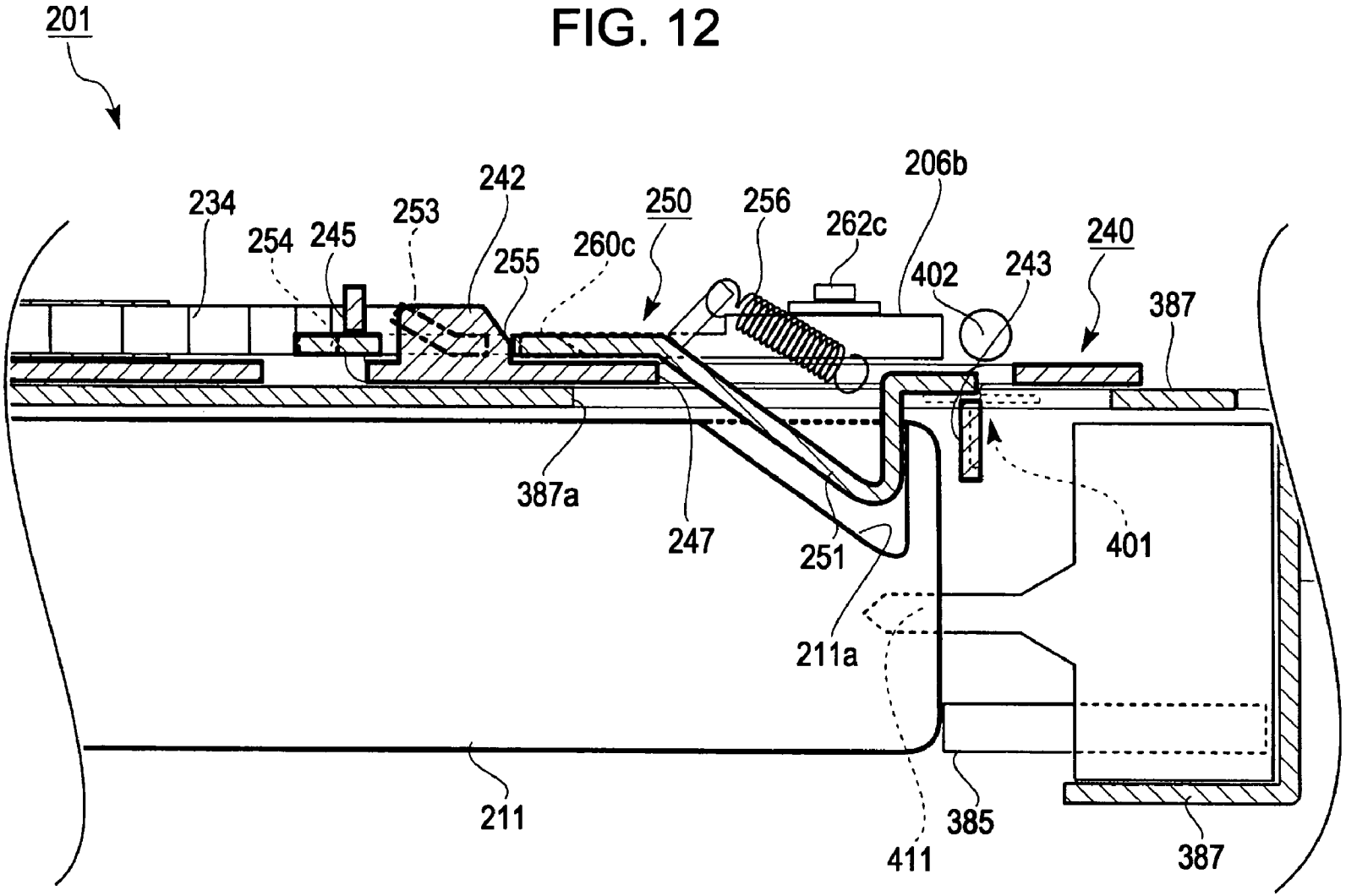
FIG. 12 is a sectional side view of an essential part of the attaching and detaching device in the course of mounting of an ink cartridge.

FIG. 11 is a plan view of the attaching and detaching device in the course of mounting of the ink cartridge. FIG. 12 is a sectional side view of an essential part of the attaching and detaching device shown in FIG. 11.

As shown in FIG. 11, when the lever arm 363 is turned about the lever shaft 364 as a fulcrum counterclockwise from the "reset position" shown in FIG. 8, the first gear 231 transmits power to the second gear 232, and the third gear 233, which is integral with the second gear 232, transmits the power to the fourth gear 234, as described above. The cam portion 235, which is integral with the fourth gear 234, comes into contact with and presses the first surface 246*a* of the first slider opening portion 246 and thus moves the slider 240 in the mounting direction. The slider 240 has the two guide slits 241*a* and 241*b* in series along the mounting direction. Passing the shafts 262*a* and 262*b*, which are provided at the base 387, through the shafts 262*a* and 262*b*, respectively, regulates the direction of movement of the slider 240.

The cam portion 235 is configured to press the central portion of the slider 240 in the width direction with respect to the mounting direction. As for the positional relationship to the latch plate 250, in the width direction, a position where the cam portion 235 presses the slider 240 is approximately on the center line of the nail portions 251 of the latch plate 250. In addition, as shown in FIG. 12, a surface where each of the nail portions 251 presses the ink cartridge 211 is perpendicular to the mounting direction. Therefore, the attitude of each of the ink cartridge 211, the latch plate 250, and the slider 240 can be stabilized while at the same time power of the cam portion 235 can be efficiently transmitted to the ink cartridge 211.

When the slider 240 is moved in the mounting direction, the ink cartridge 211 held by the nail portions 251 of the latch plate 250 is also moved integrally therewith. At this time, the weight of the ink cartridge 211 loosens engagement of the slider engagement portion 245 and the latch-plate engagement portion 254, and, in the second engagement unit, the slider projection 242 engaging with the corresponding latch-plate slit 255 presses a surface that faces the mounting direction (see FIG. 28). This pressing force moves the ink cartridge 211 in the mounting direction via the nail portions 251. As the ink cartridge 211 moves, the ink supply needle 411 adjacent to the leading end in the mounting direction is gradually pierced in the ink cartridge 211.

At this time, a large pressing force is necessary for causing the ink supply needle 411 to pierce the ink cartridge 211. Since the slider projection 242 is provided by bending in a direction perpendicular to the mounting direction, as described above, even if a large pressing force is exerted, there is no possibility of flection or deformation. That is, the slider projection 242 can be in surface contact with a surface that faces the mounting direction (see FIG. 28) and reliably transmit the pressing force to the ink cartridge 211 via the latch plate 250. In addition, since the slider projection 242 is not deformed, the latch plate 250 can be accurately positioned.

A reason why the first engagement unit and the second engagement unit can engage the latch plate 250 and the slider 240 is that, if a shaft was provided to allow the latch plate 250 to swing, a large pressing force required for mounting the ink cartridge 211 would be focused on the shaft, the shaft would be deformed, and the possibility of being unable to obtain sufficient pressing force and accuracy of a pressing distance for pressing the ink cartridge 211 would arise. Therefore, without the provision of the shaft, by changing the location of engagement by the operation of the latch plate 250, the pressing force and the pressing distance (second predetermined stroke S2) can be ensured while a function of swinging in the latch plate 250 is maintained.

In addition, since each of the slider engagement portions 245 and each of the latch-plate engagement portions 254, which constitute the first engagement unit, and each of the slider projections 242 and each of the latch-plate slits 255, which constitute the second engagement unit, are disposed in series with respect to the nail portions 251 in the mounting direction, the nail portions 251 of the latch plate 250 can be positioned more accurately. Moreover, since the pair of first engagement units and the pair of second engagement units are provided in the width direction with respect to the mounting direction, the attitude of the latch plate 250 can be stabilized. Furthermore, since the second engagement units are disposed in series with respect to the nail portions 251 in the mounting direction, a pressing force can be efficiently transmitted to the nail portions 251.

The slider projection 242 and the latch-plate slit 255, which constitute the second engagement unit, regulate the position of the latch plate 250 with respect to the slider 240 in the width direction. Therefore, at the insertion of the ink cartridge 211, as described above, the depressions 211*a* of the ink cartridge 211 can reliably face and engage with the nail portions 251 of the latch plate 250.

In a direction of the height of the ink cartridge 211 (the vertical direction in FIG. 12), the closer the position of engagement of the nail portions 251 and the depressions 211*a* is to a position where the ink supply needle 411 is embedded in the ink cartridge 211, the more stable the attitude of the ink cartridge 211 becomes and the more efficient a pressing force during mounting being a power of the cam portion 235 is transmitted to the ink cartridge 211. Although it is necessary to consider the relationship to a path of the lower end of each of the nail portions 251 while the latch plate 250 upwardly swing in a dismounting process, which will be described below, the position of engagement of the nail portions 251 and the depressions 211*a* may preferably be opposed to the ink supply needle 411 in the height direction of the ink cartridge 211.

Subsequently, when the lever arm 363 is tuned toward the "set position" side, together with the slider 240 in the mounting direction, shoulder portions 252 of the slider 240 come into contact with an end contact portion 260*c* of the cancelling arm 260*a* and an end contact portion 260*c* of the cancelling arm 260*b*, respectively, thus causing the cancelling arms 260*a* and 260*b* to turn about the shaft 262*c*, as a fulcrum, passing through a slit 241*c* and on the shaft 262*a* passing through the guide slit 241*a*, respectively, against an urging force of the cancelling-arm springs 261 (see FIG. 11). At this time, since the shoulder portions 252 receive the pressing force from the respective end contact portions 260*c*, the slider projections 242 are in contact with the respective surfaces that face the mounting direction (see FIG. 28) more reliably. That is, the urging force of the cancelling-arm springs 256 can stabilize the attitude of the latch plate 250.

Figure 14:
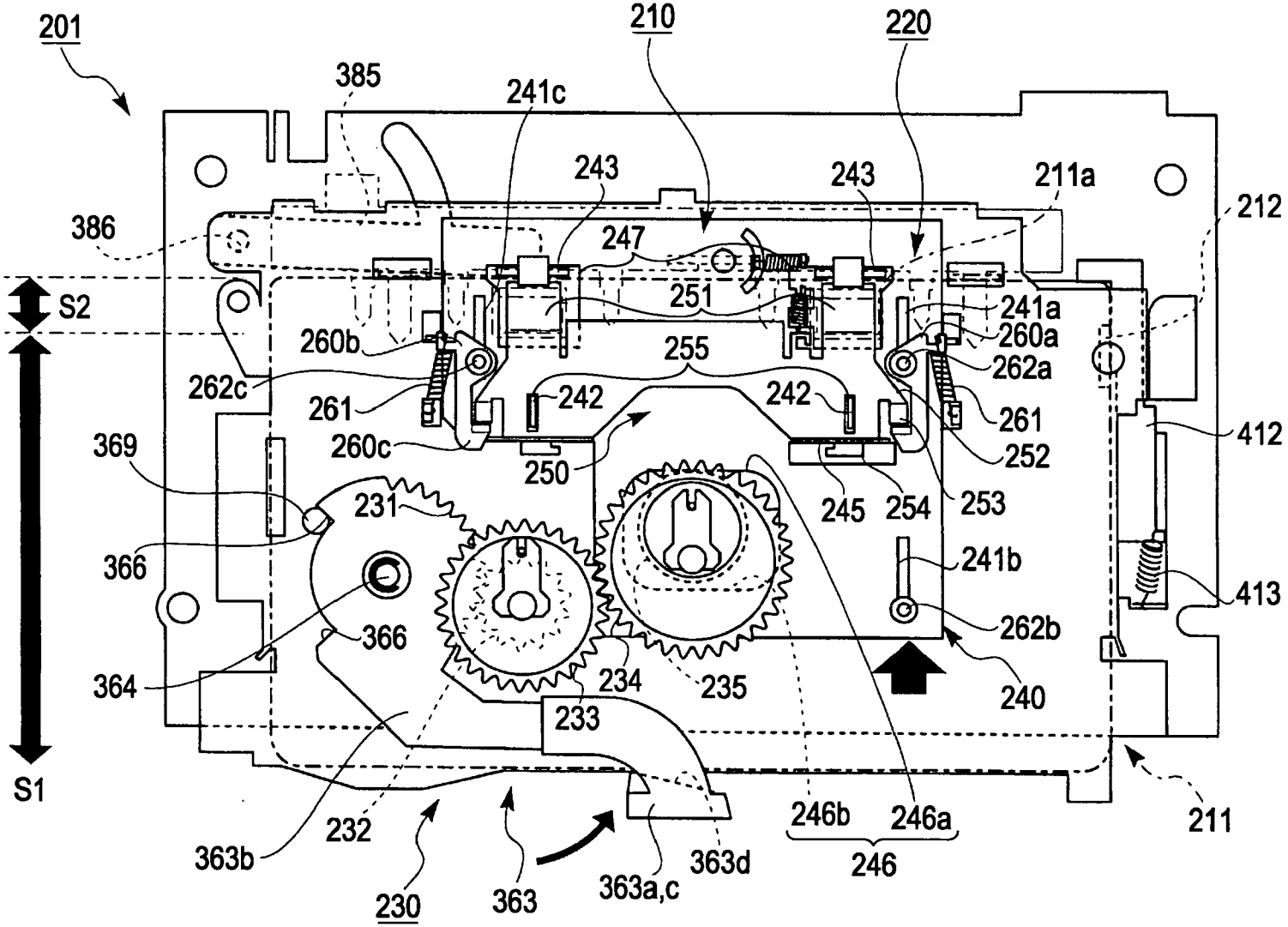
FIG. 14 is a plan view of the attaching and detaching device when the lever arm is in a set position at completion of mounting.

When the slider 240 further moves in the mounting direction and the shoulder portions 252 pass through the respective end contact portions 260*c* of the cancelling arms 260*a* and 260*b*, the cancelling arms 260*a* and 260*b* return to their original states by the urging force of the cancelling-arm springs 261 (see FIGS. 5, 8, and 14). Each of the cancelling arms 260*a* and 260*b* is a member that acts on the latch plate 250 during the dismounting of the ink cartridge 211, so the details thereof will be described below in the description of the dismounting.

When the lever arm 363 is turned counterclockwise up to the "set position", the mounting of the ink cartridge 211 is completed.

Figure 13:
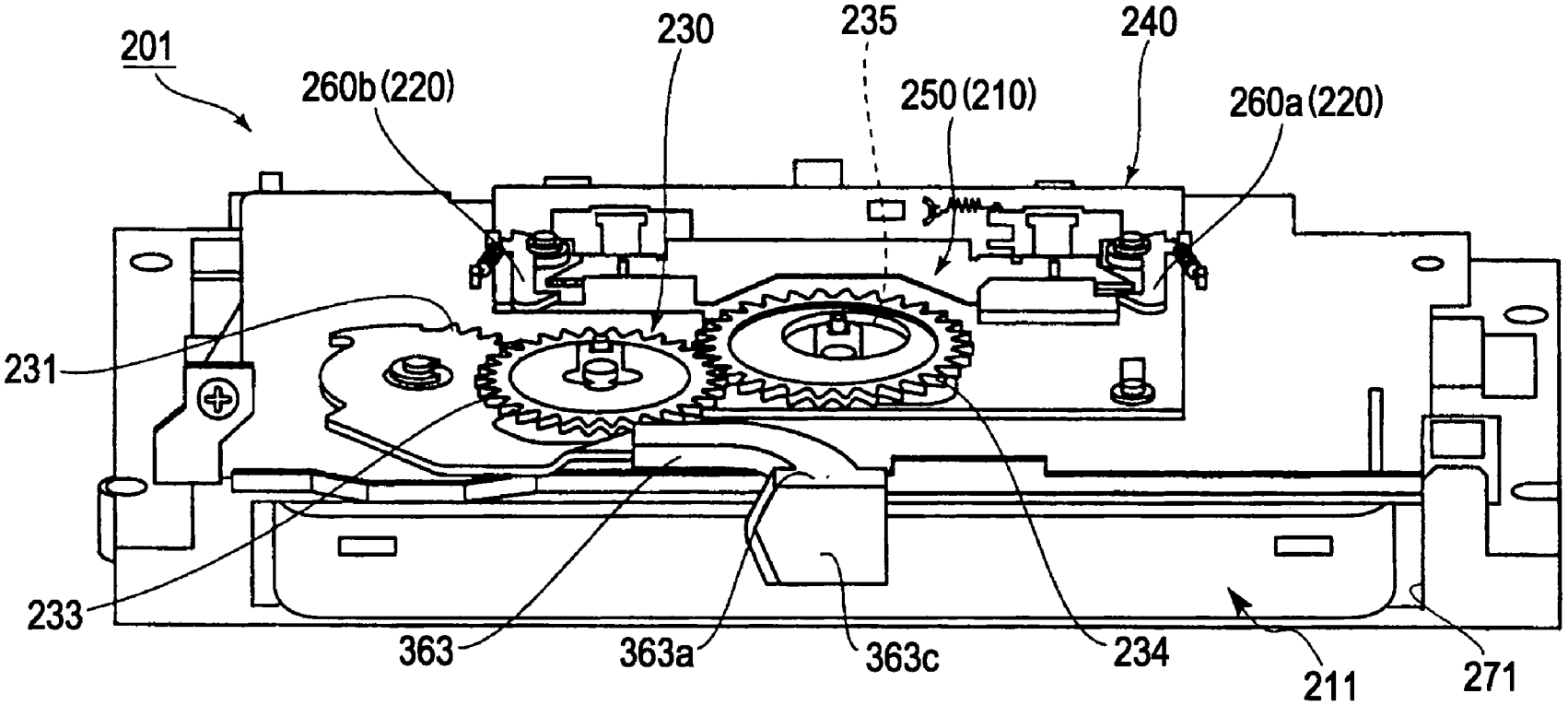
FIG. 13 is a front perspective view of the attaching and detaching device when the lever arm is in a set position at completion of mounting.
Figure 15:
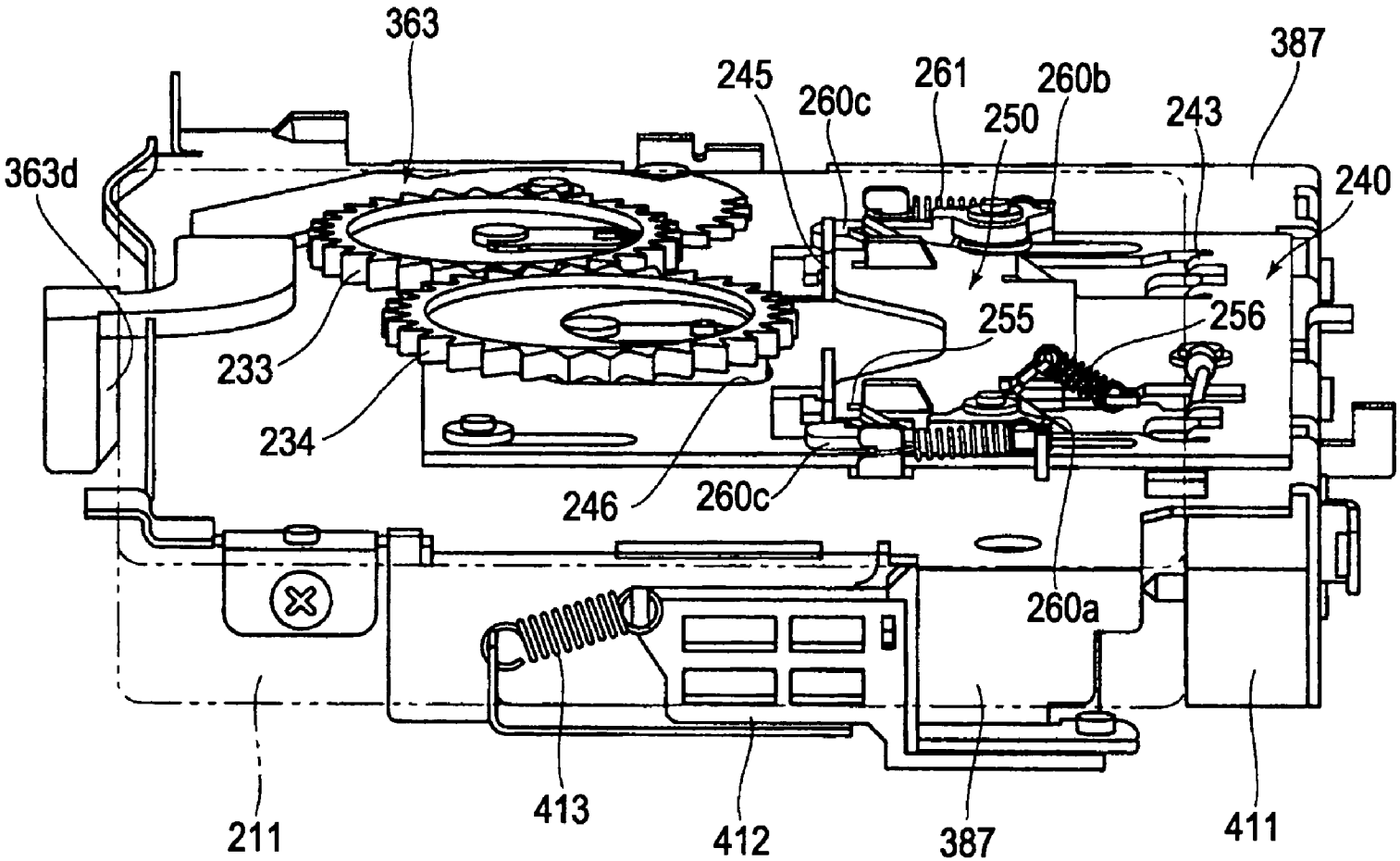
FIG. 15 is a side perspective view of the attaching and detaching device when the lever arm is in a set position at completion of mounting.
Figure 16:
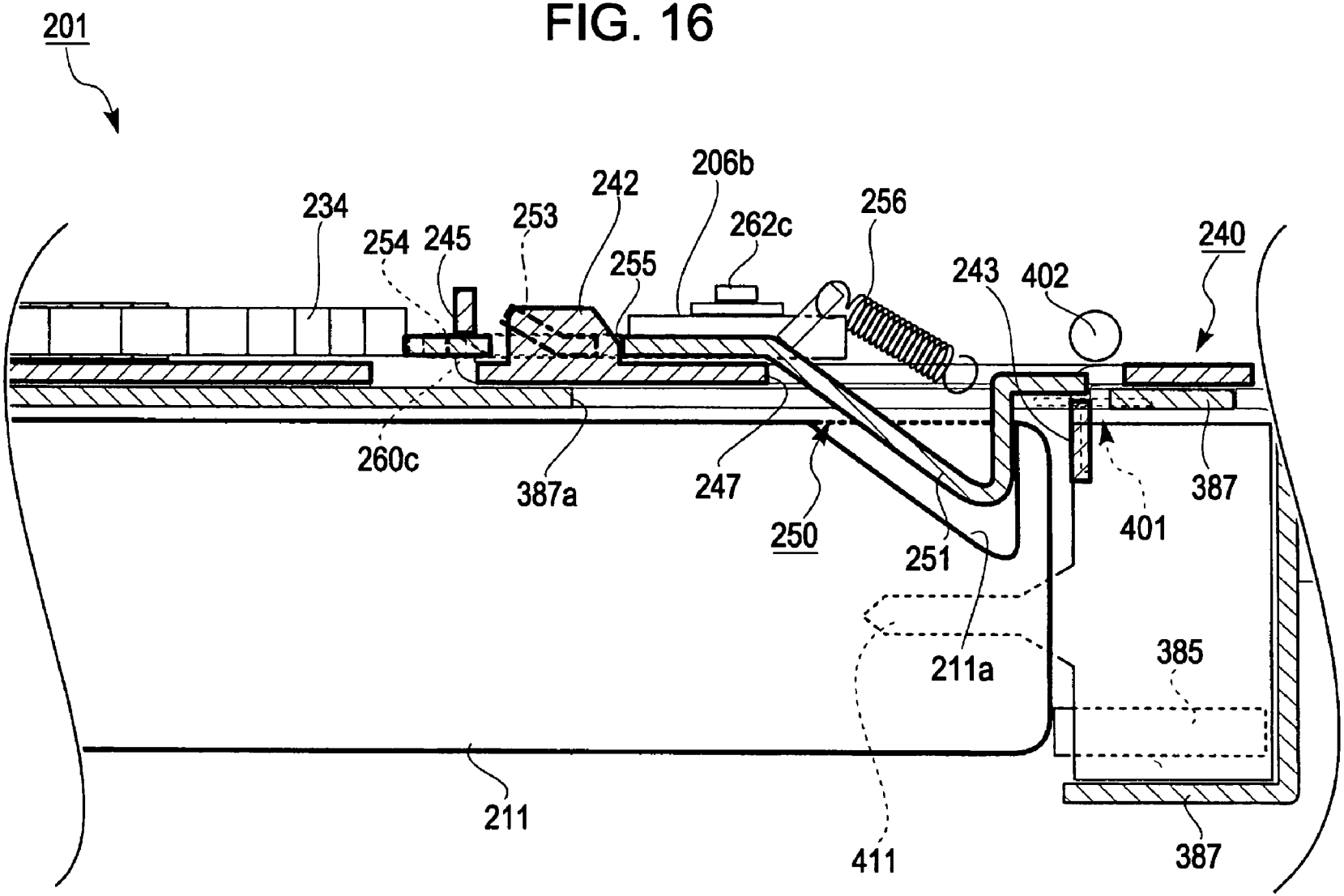
FIG. 16 is a sectional side view of an essential part of the attaching and detaching device when the lever arm is in a set position at completion of mounting.

FIG. 13 is a front perspective view of the attaching and detaching device when the lever arm is in the "set position" at completion of mounting. FIG. 14 is a plan view of the attaching and detaching device shown in FIG. 13. FIG. 15 is a side perspective view of the attaching and detaching device shown in FIG. 13. FIG. 16 is a sectional side view of an essential part of the attaching and detaching device shown in FIG. 13.

As shown in FIGS. 13 to 16, when the lever arm 363 is further turned from a state shown in FIGS. 11 and 12 up to the "set position", the ink cartridge 211 is in a state in which the ink supply needle 411 is fully embedded in the ink cartridge 211 after the ink cartridge 211 moves from a state of completion of insertion of the ink cartridge 211 (see FIGS. 8 to 10) by a second predetermined stroke S2 in the mounting direction, i.e., a state of completion of mounting of the ink cartridge 211.

The ink cartridge 211 has an ink remaining information terminal 212 at the right front side. The ink remaining information terminal 212 is configured to be electrically connected to a connector 412 provided at the main body of the attaching and detaching device immediately before the mounting of the ink cartridge 211 is completed. The connector 412 is configured to be movable by a fixed distance in the mounting direction and to be capable of following the movement of the ink cartridge 211 by a connector spring 413 and a contact surface of the connector 412, the contact surface being provided at the leading end in the mounting direction and being capable of coming into contact with the leading-end surface of the ink cartridge 211.

When the connector 412 electrically contacts the ink remaining information terminal 212 and when the electrical connection becomes released, friction arises between the connector 412 and the ink cartridge 211.

In addition, immediately before the mounting of the ink cartridge 211 is completed, the leading end of the ink cartridge 211 comes into contact with a valve lever (not shown) for switching opening and closing an ink channel valve (not shown) provided at the main body of the attaching and detaching device. The valve lever is configured to urge the ink cartridge 211 in the dismounting direction by a spring (not shown), as is the case with the dismounting lever 385. When the leading end of the ink cartridge 211 is not in contact with the valve lever, the ink channel valve is blocked. When the leading end of the ink cartridge 211 comes into contact with the valve lever and moves the valve lever against an urging force upon completion of mounting of the ink cartridge, the ink channel valve is made open.

[Dismounting of Ink Cartridge]

Figure 17:
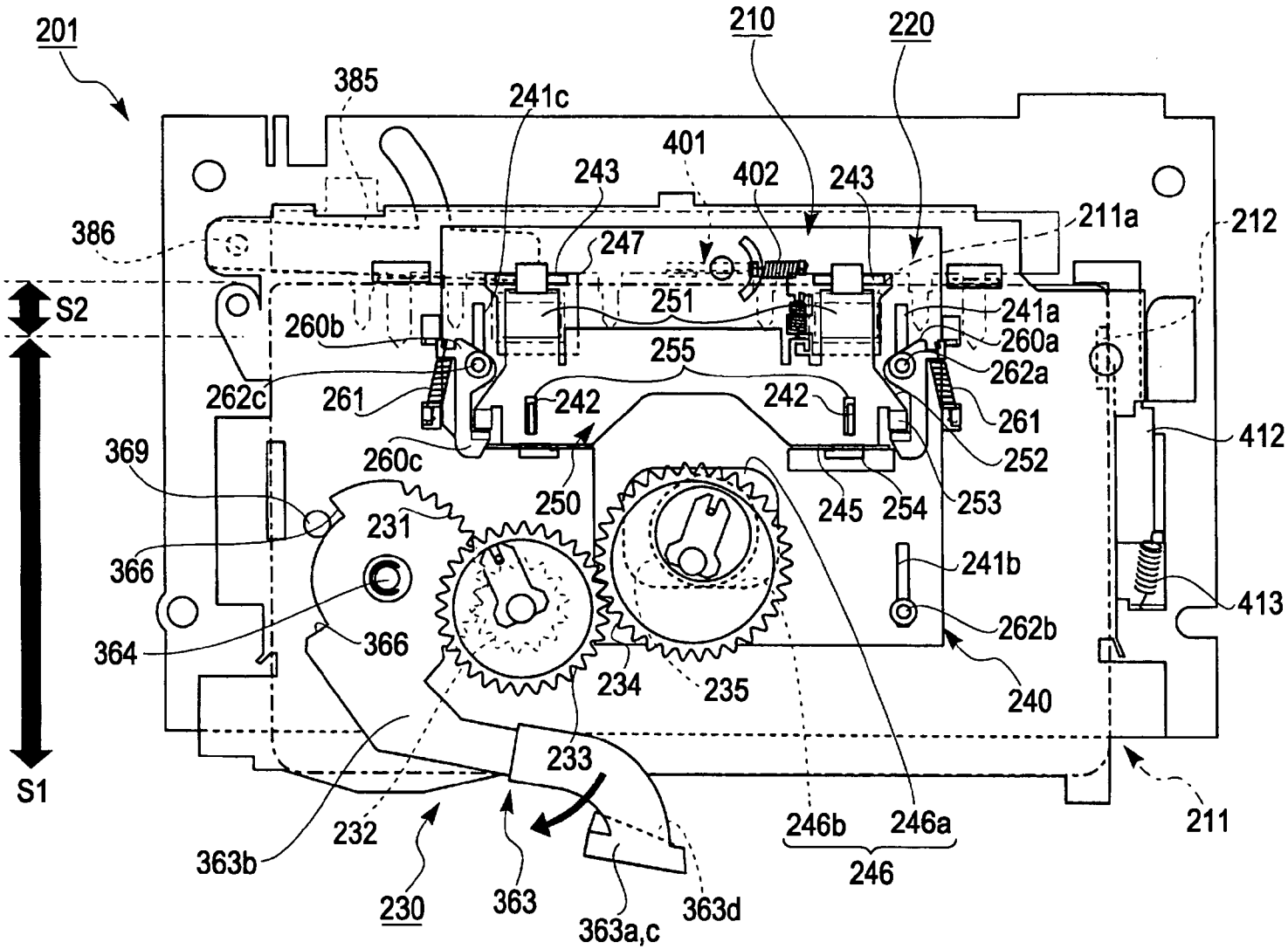
FIG. 17 is a plan view of the attaching and detaching device in the course of dismounting of the ink cartridge.
Figure 18:
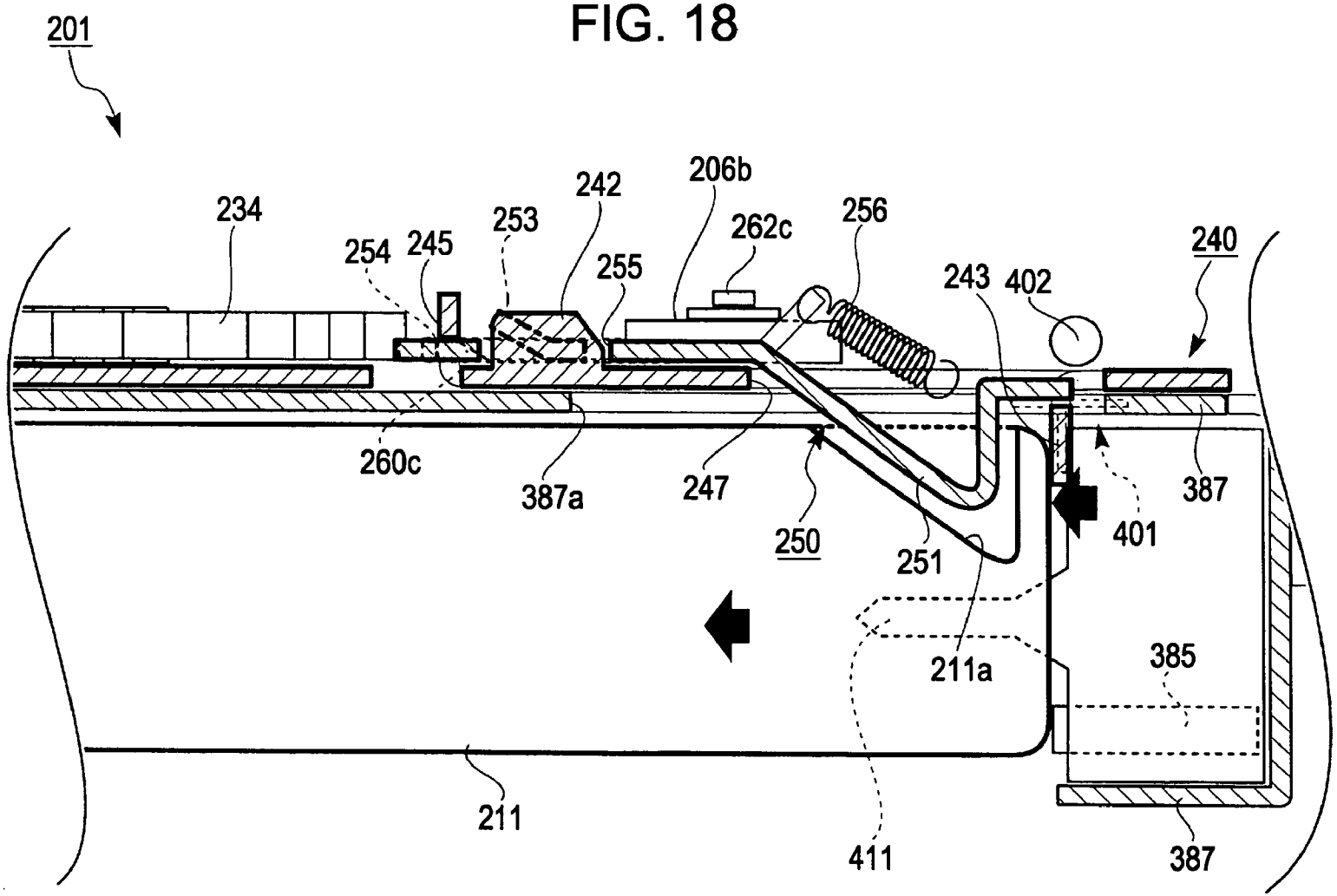
FIG. 18 is a sectional side view of an essential part of the attaching and detaching device in the course of dismounting of the ink cartridge.

FIG. 17 is a plan view of the attaching and detaching device in the course of dismounting of the ink cartridge. FIG. 18 is a sectional side view of an essential part of the attaching and detaching device shown in FIG. 17.

During dismounting of the ink cartridge 211, the lever arm 363 is turned clockwise from the "set position", shown in FIG. 13, to the "reset position", shown in FIGS. 5 and 8. The operation of the attaching and detaching device 201 during this dismounting is complicated, so the operation will be described below for each stage.

As shown in FIGS. 17 and 18, when the lever arm 363 is slightly turned from the "set position" toward the "set position" side, a power of the turning of the lever arm 363 is transmitted to the cam portion 235, as described above. The cam portion 235 comes into contact with and presses the second surface 246*b* of the first slider opening portion 246 of the slider 240 and slightly moves the slider 240 in the dismounting direction. At this time, since the ink supply needle 411 is embedded in the ink cartridge 211, the ink cartridge 211 does not move until the ink cartridge 211 comes into contact with the abutment portions 243, which are provided at the leading end of the slider 240 in the mounting direction (see FIG. 18). As the slider 240 is slightly moved in the dismounting direction, the latch plate 250 also moves in the dismounting direction. At this time, engagement of the nail portions 251 of the latch plate 250 and the depressions 211*a* of the ink cartridge 211 becomes loose, and a gap (clearance) is generated between the nail portions 251 and the depressions 211*a*. Therefore, at this time, the nail portions 251 do not receive any force from the ink cartridge 211. The latch-plate spring 256 is exerted on the latch plate 250, thereby causing the leading end in the mounting-direction of the latch-plate slit 255 of the latch plate 250 and the slider projection 242, which have been in contact with each other at the mounting, to be separated and causing the latch plate 250 to engage with the slider 240 by the first engagement unit.

Since the urging force of the dismounting lever 385 is smaller than the frictional force between the ink cartridge 211 and the ink supply needle 411, the ink cartridge 211 does not move.

Figure 19:
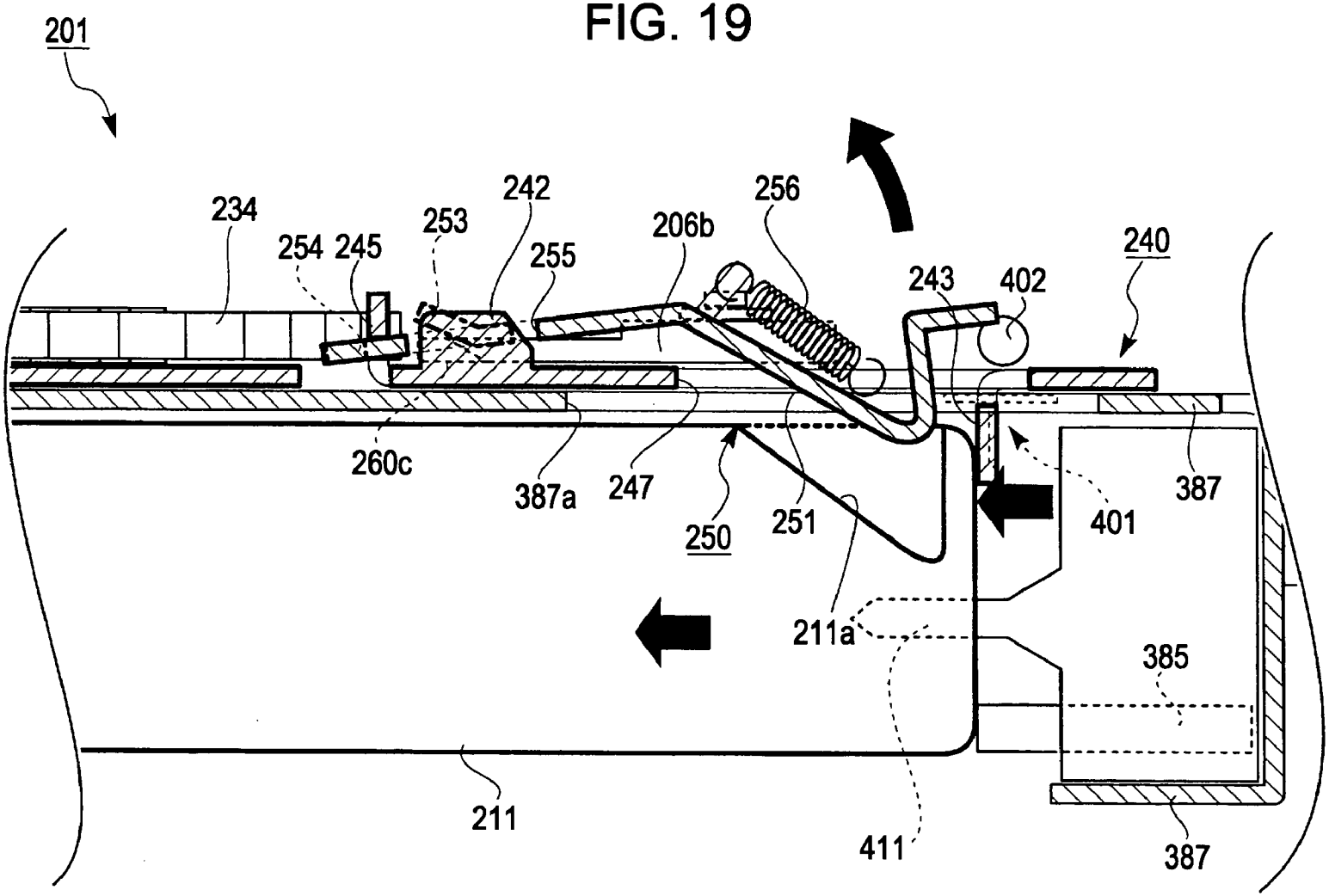
FIG. 19 is a sectional side view of an essential part of the attaching and detaching device in the course of dismounting of the ink cartridge (a latch plate is raised).

FIG. 19 is a sectional side view of an essential part of the attaching and detaching device in the course of dismounting of the ink cartridge.

As shown in FIG. 19, when the lever arm 363 is gradually turned from a state shown in FIGS. 17 and 18 toward the "reset position" side further, the slider 240 gradually moves toward the left side of the drawing further, which is the dismounting direction. At this time, the abutment portions 243 provided at the slider 240 are in contact with and press the leading end of the ink cartridge 211. Therefore, the abutment portions 243 gradually the ink cartridge 211 toward the left side, which is the dismounting direction, against a frictional force between the ink cartridge 211 and the ink supply needle 411. At this time, the abutment portions 243 are disposed so as to face the nail portions 251. As is the case of during mounting, in which the ink cartridge 211 is pressed in by the nail portions while the attitude of the ink cartridge 211 is stabilized, during dismounting, the two abutment portions 243 can move the ink cartridge 211 in the dismounting direction while at the same time the attitude of the ink cartridge 211 is stabilized.

As the slider 240 moves in the dismounting direction, the pair of oblique portions 253 of the latch plate 250 gradually overlie the respective end contact portions 260*c* of the cancelling arms 260*a* and 260*b*. At this time, the end contact portions 260*c* urge the latch plate 250 via the oblique portions 253 so as to cause the latch plate 250 to be engaged by the first engagement unit while at the same time upwardly pushing the latch plate 250 via the oblique portions 253. Then, the latch plate 250 starts swinging upwardly about a position, as a fulcrum, where the slider engagement portion 245 and the latch-plate engagement portion 254, which constitute the first engagement unit.

At this time, although the diameter of a path of the lower end of each of the nail portions 251 is greater than that of the other area because the nail portions 251 extend downward, the nail portions 251 can rise without undergoing frictional resistance due to the gap between the nail portions 251 and the depressions 211*a*, as described above. Here, although the gap is very slight, since the first engagement unit is engaged by surface contact and the position and the path of the nail portions 251 can be accurately set, there is no possibility that, during upward swinging of the latch plate 250, frictional resistance between the nail portions 251 and the depressions 211*a* will be generated.

Figure 20:
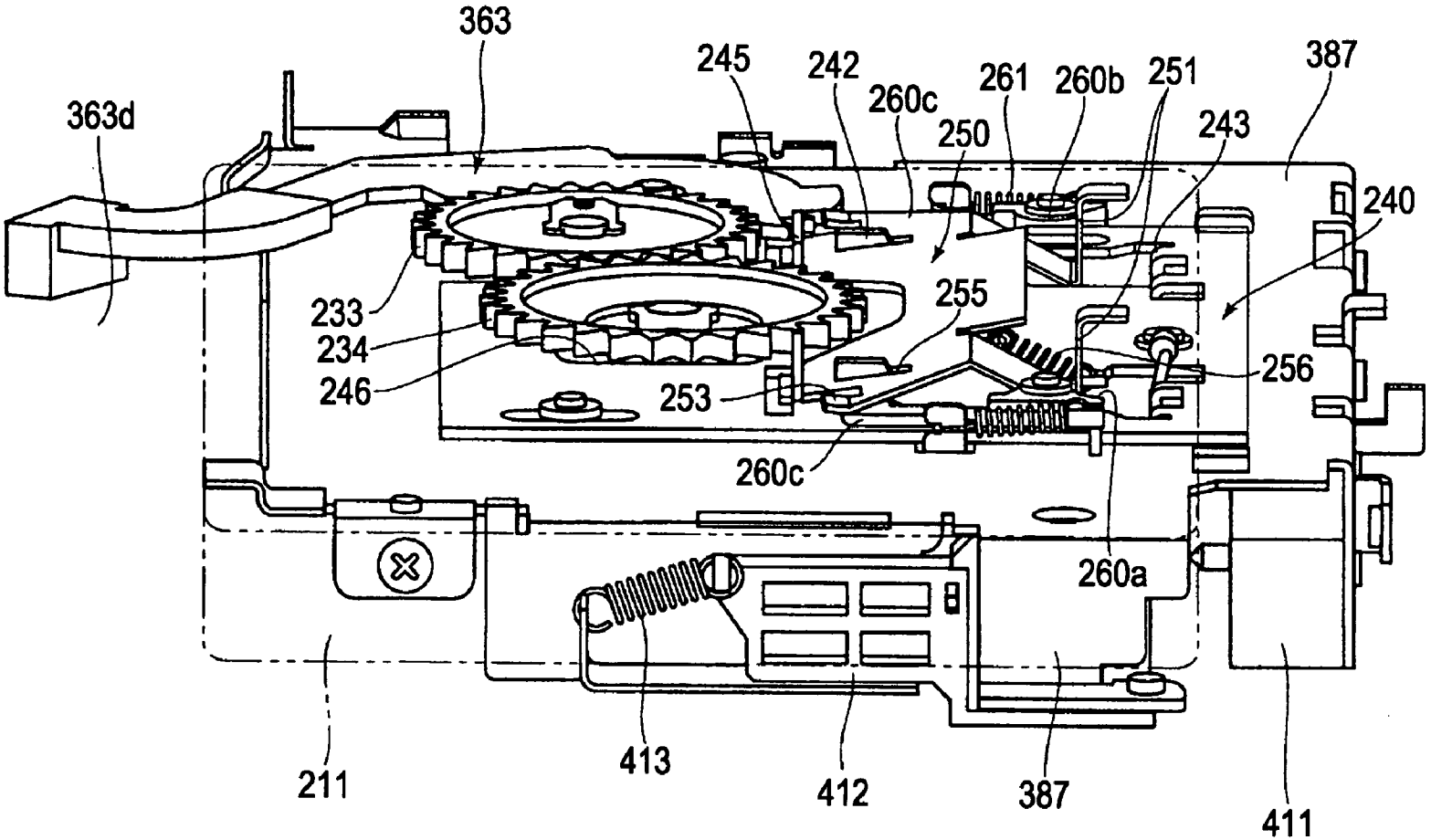
FIG. 20 is a sectional side view of the attaching and detaching device in the course of dismounting of the ink cartridge (forced extrusion).
Figure 21:
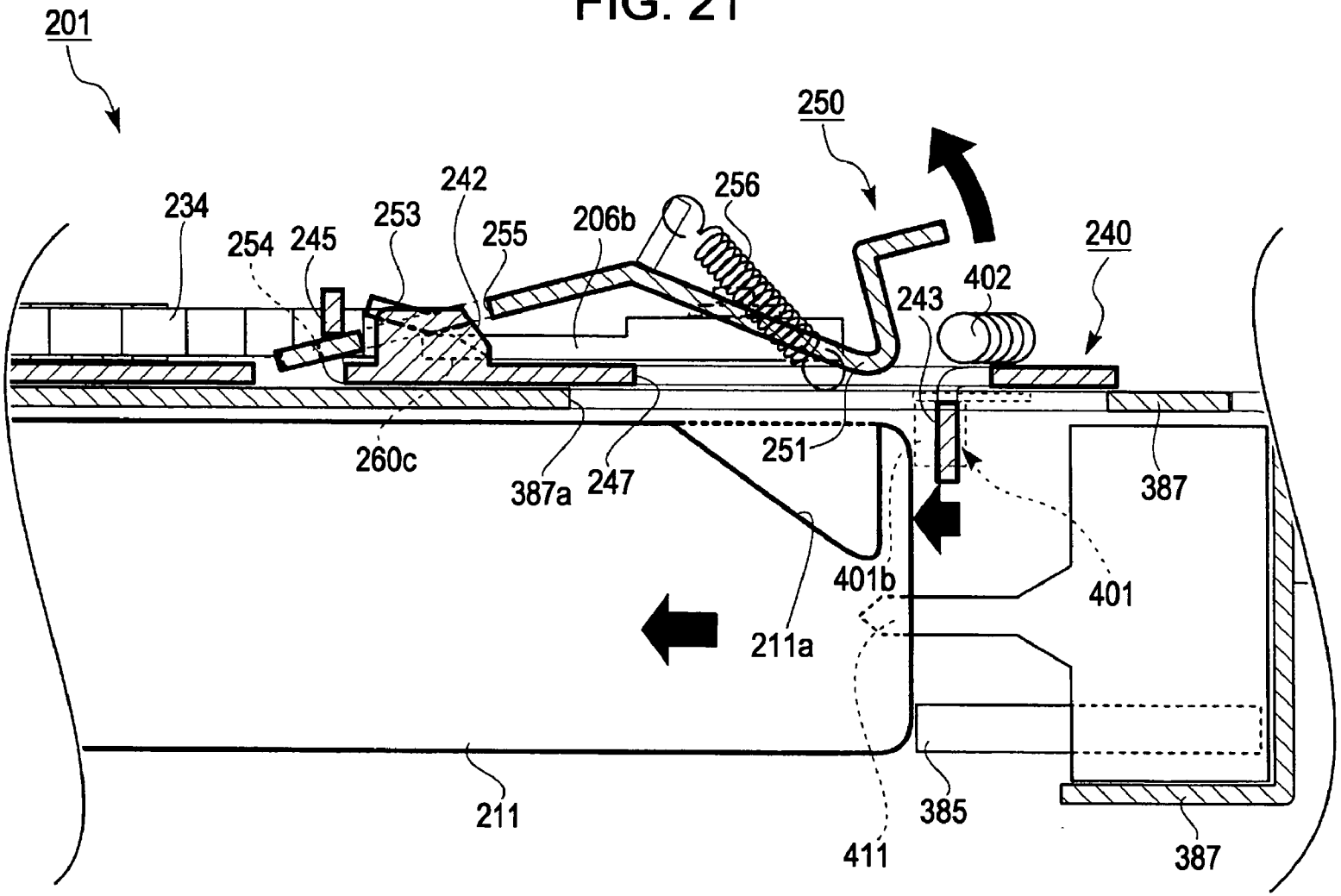
FIG. 21 is a sectional side view of an essential part of the attaching and detaching device in the course of dismounting of the ink cartridge (forced extrusion).

FIG. 20 is a sectional side view of an essential part of the attaching and detaching device in the course of dismounting of the ink cartridge. FIG. 21 is a sectional side view of an essential part of the attaching and detaching device shown in FIG. 20.

As shown in FIGS. 20 and 21, when the lever arm 363 is gradually turned from a state shown in FIG. 19 toward the "reset position" side further, the slider 240 is gradually moved in the dismounting direction further. At this time, the oblique portions 253 of the latch plate 250 fully overlie the respective end contact portions 260*c* of the cancelling arms 260*a* and 260*b*. Therefore, the latch plate 250 reaches a highest point of upward swinging, the nail portions 251 are fully removed from the depressions 211*a*, and engagement thereof is released.

At this time, since the upward swinging of the latch plate 250 needs a gap between the nail portion 251 and the respective depression 211*a*, the upward swinging is performed in a period of time during the abutment portions 243 move the ink cartridge 211 in the dismounting direction.

Until the ink supply needle 411 is almost fully removed from the ink cartridge 211 and relatively large frictional resistance between the ink cartridge 211 and the ink supply needle 411 becomes lost, the abutment portions 243 move the ink cartridge 211 in the dismounting direction.

After the frictional resistance between the ink cartridge 211 and the ink supply needle 411 becomes lost, an extrusion lever 401 with which the slider 240 is provided is exerted, so that the ink cartridge 211 is forced in the dismounting direction with respect to the slider 240, which is the cartridge holding unit 210. The extrusion lever 401 is configured to move the ink cartridge 211 against relatively small frictional resistance between the ink cartridge 211 and the connector 412, described above.

Here, the extrusion lever 401 includes an extrusion portion 401*b* (see FIG. 22) at its first end and a contact portion 401*a* (see FIG. 22) at its second end. The extrusion portion 401*b* is configured to extrude the ink cartridge 211 in contact therewith. The contact portion 401*a* is configured to come into contact with and engage with a projection (not shown) provided at the base 387 of the attaching and detaching device 201. The extrusion lever 401 is configured to, when engagement of the projection (not shown) and the contact portion 401*a* is released, return to its original position (shown in FIG. 17) by means of an extrusion-lever spring 402. Specifically, when the slider 240 moves in the dismounting direction, the contact portion 401*a* of the extrusion lever 401 moving together with the slider 240 engages with the projection (not shown) of the base 387. This causes the extrusion lever 401 to turn by using the contact portion 401*a* as the point of a lever where force is applied and causes the ink cartridge 211 to be forced by a third predetermined stroke S3 (see FIGS. 22 and 23) in the dismounting direction with respect to the slider 240 by using the extrusion portion 401*b* as the point of application.

At this time, since the extrusion lever 401 moves the ink cartridge 211 by the third predetermined stroke S3 with respect to the slider 240 in the dismounting direction, even if the latch plate 250 swings downward by an operation of inversely turning the lever arm 363 toward the "set position" side, a so-called erroneous operation (abnormal operation), there is no possibility of re-engagement of the nail portions 251 and the depressions 211*a*.

The term "third predetermined stroke S3" as used herein refers to the distance that the ink cartridge 211 moves with respect to the slider 240, the distance being the distance of movement for the ink cartridge 211 from a position where the nail portions 251 engage with the respective depressions 211*a* to a position where the nail portions 251 do not engage with the respective depressions 211*a*.

In FIG. 21, it would appear that the ink supply needle 411 is embedded in the ink cartridge 211, but the ink supply needle 411 is fully disconnected from a gasket (not shown) of an opening of the ink cartridge for allowing the ink supply needle 411 to pass through and frictional resistance between the ink cartridge 211 and the ink supply needle 411 is not present.

In this embodiment, the extrusion lever 401 is configured to act against relatively small frictional resistance between the ink cartridge 211 and the connector 412. However, of course, the extrusion lever 401 may be configured to act against relatively large between the ink cartridge 211 and the ink supply needle 411.

Figure 22:
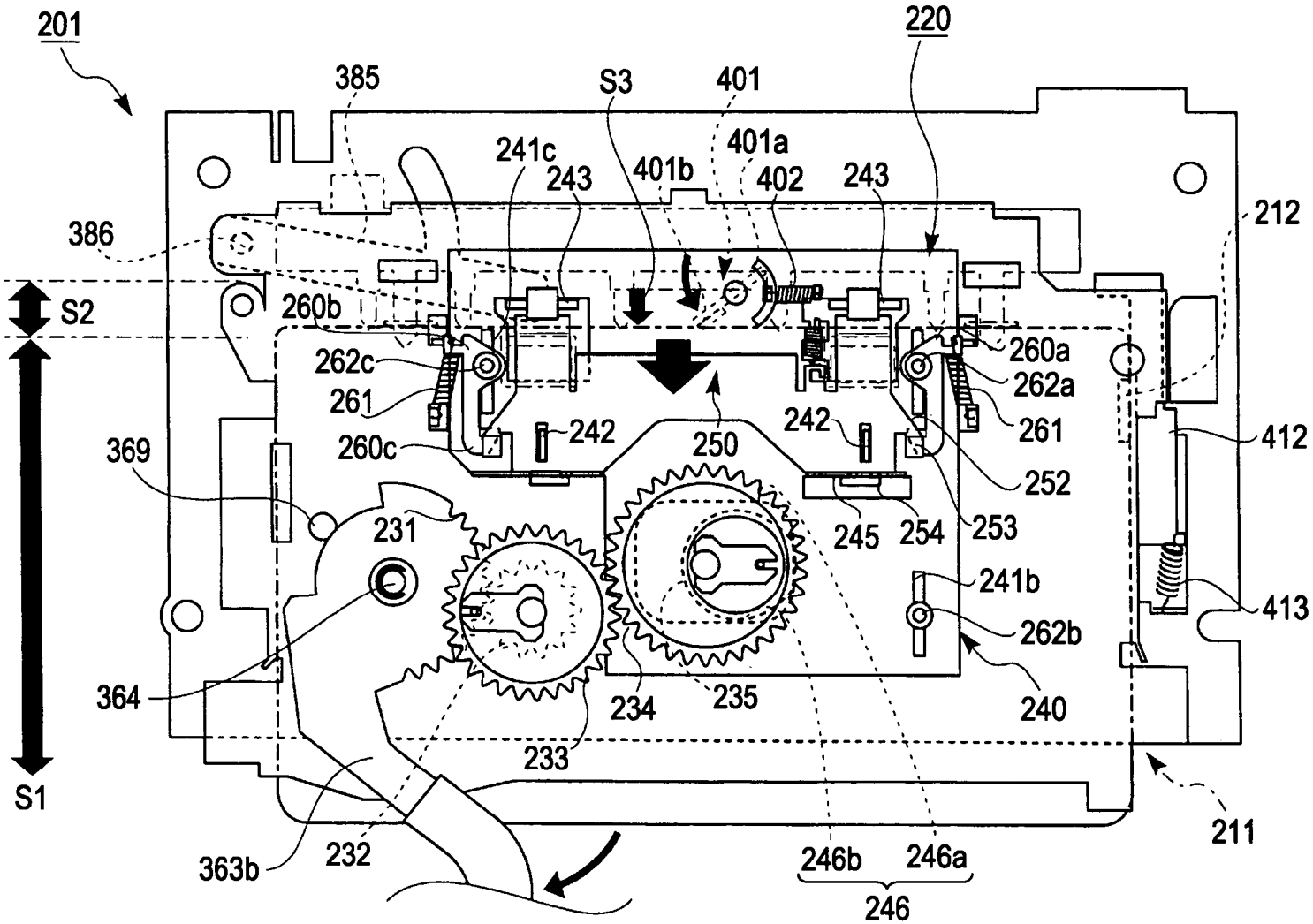
FIG. 22 is a plan view of the attaching and detaching device in the course of dismounting of the ink cartridge (spring-urged extrusion).
Figure 23:
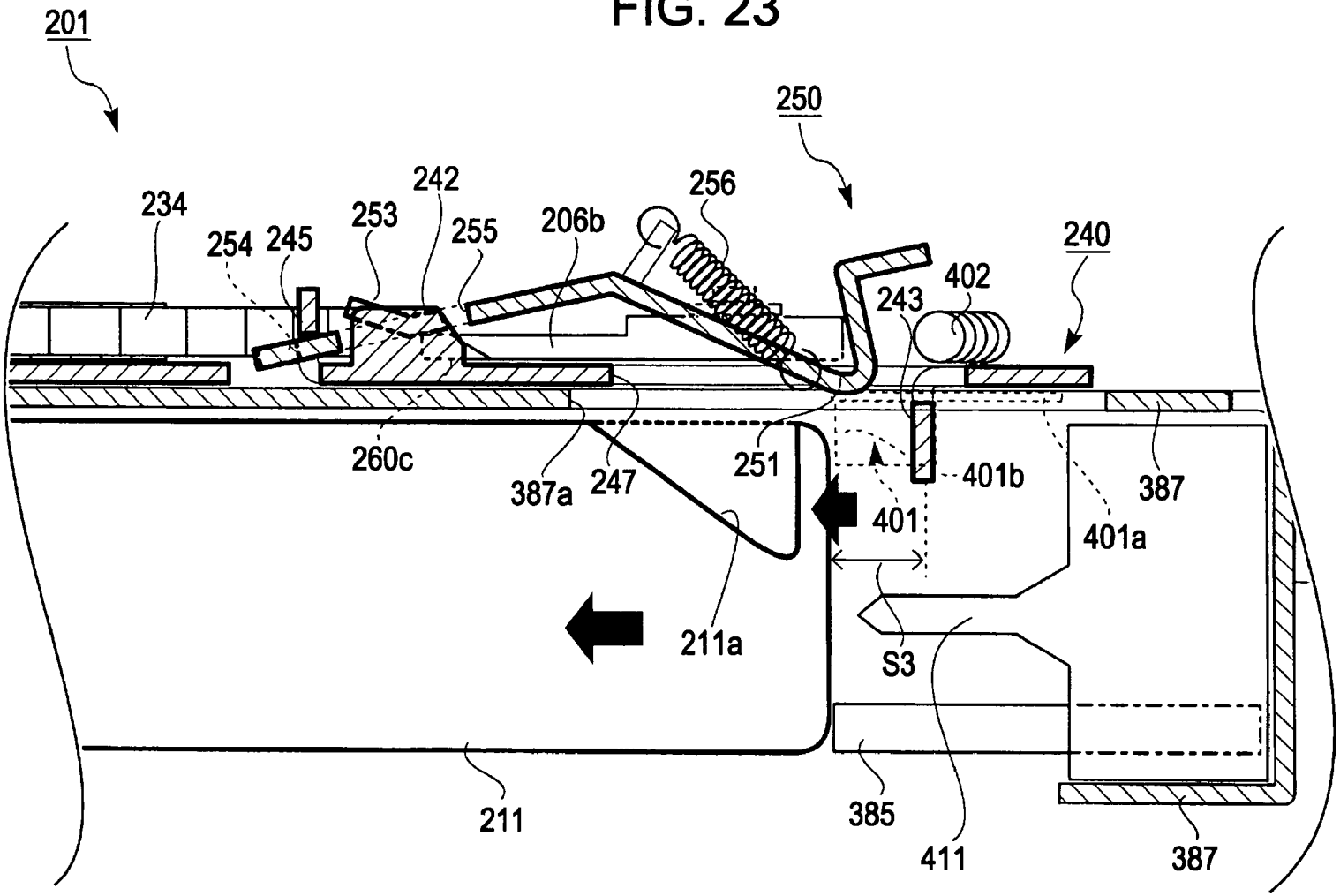
FIG. 23 is a sectional side view of an essential part of the attaching and detaching device in the course of dismounting of the ink cartridge (spring-urged extrusion).

FIG. 22 is a plan view of the attaching and detaching device in the course of dismounting of the ink cartridge. FIG. 23 is a sectional side view of an essential part of the attaching and detaching device shown in FIG. 22.

As shown in FIGS. 22 and 23, when the lever arm 363 is gradually turned from a state shown in FIGS. 20 and 21 toward the "set position" side further, the slider 240 is gradually moved in the dismounting direction further. Then, after the extrusion lever 401 moves the ink cartridge 211 with respect to the slider 240 against relatively small frictional resistance between the ink cartridge 211 and the slider 240, little frictional resistance between the ink cartridge 211 and the attaching and detaching device 201 is present. As a result, the urging force of the dismounting lever 385 is just about to push the ink cartridge 211 out in the dismounting direction.

Figure 24:
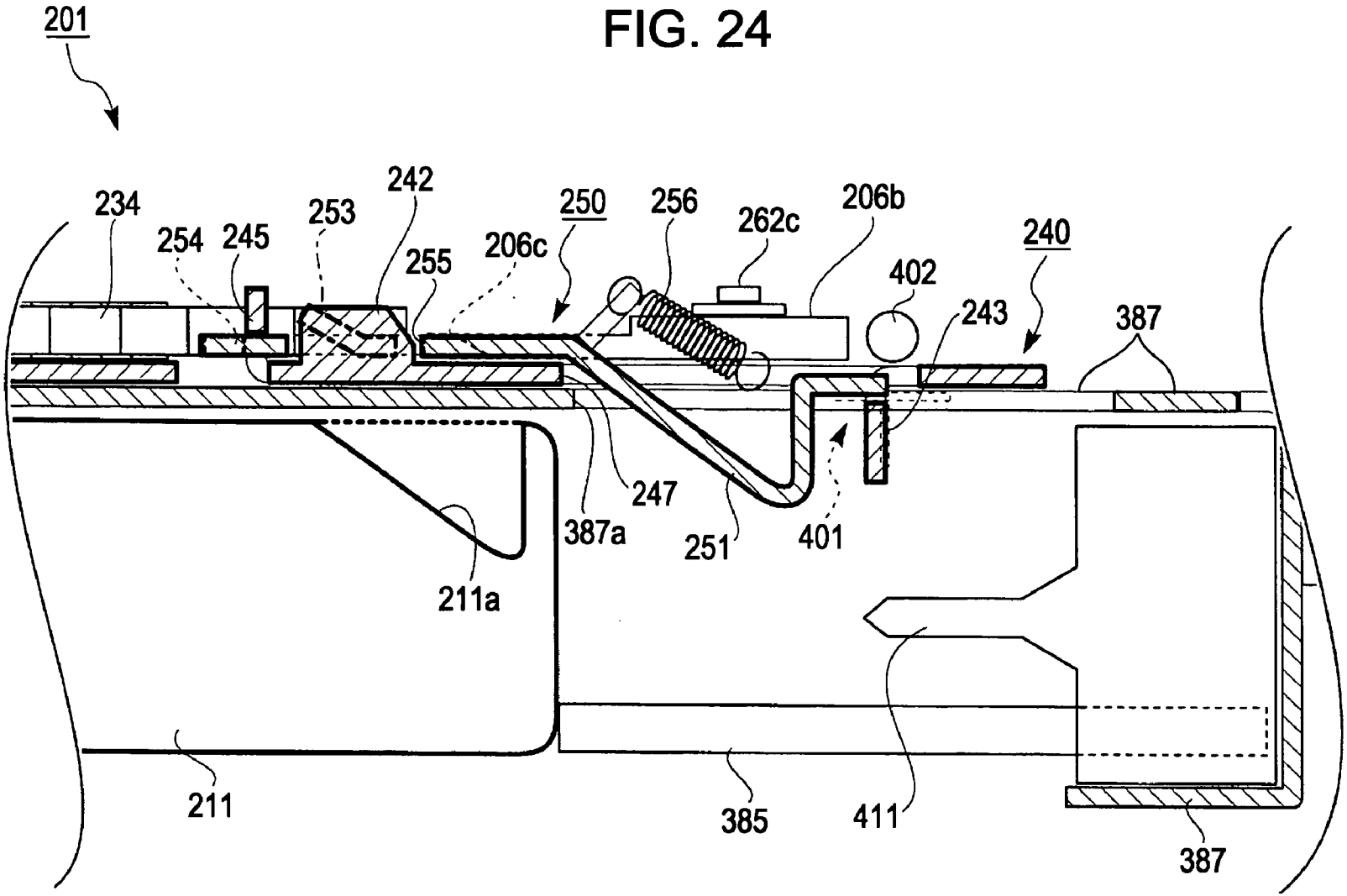
FIG. 24 is a sectional side view of an essential part of the attaching and detaching device in the course of dismounting of the ink cartridge (the latch plate is lowered).

FIG. 24 is a sectional side view of an essential part of the attaching and detaching device in the course of dismounting of the ink cartridge. As shown in FIG. 24, when the lever arm 363 is gradually turned from a state shown in FIGS. 22 and 23 toward the "reset position" side further, the slider 240 gradually moves in the dismounting direction further. At this time, the ink cartridge 211 is extruded in the dismounting direction by an urging force of the dismounting lever 385. Then, the oblique portions 253 of the latch plate 250 ride over the respective end contact portions 260*c* of the cancelling arms 260*a* and 260*b*. As a result, the latch plate 250 swings downward after the ink cartridge 211 is moved in the dismounting direction by the dismounting lever 385.

The ink cartridge 211 moved in the dismounting direction by the urging force of the dismounting lever 385 protrudes approximately half thereof out of the insertion opening 271, comes into contact with the lever projection 363*c* of the lever arm 363, and stops.

When the lever arm 363 is fully turned to the "reset position" (see FIGS. 4 to 6, 8, and 9) and the lever projection 363*c* is moved out of the approach path A, the ink cartridge 211 can be removed from the insertion opening 271.

Figure 25:
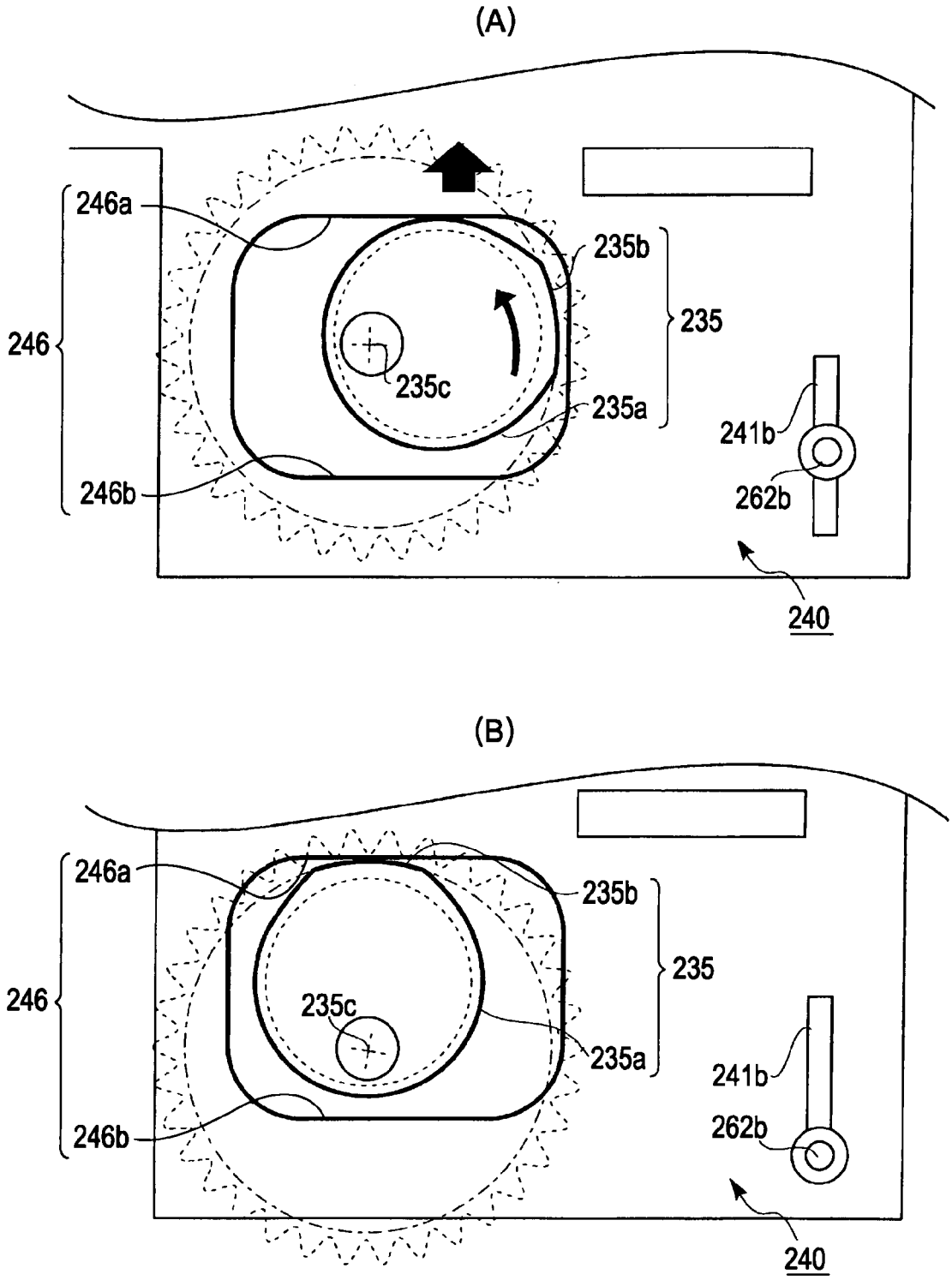
FIGS. 25(A) and 25(B) are plan views showing the shape of a cam portion according to the present invention.

FIGS. 25(A) and 25(B) are plan views showing the shape of a cam portion according to the present invention.

As shown in FIGS. 25(A) and 25(B), the cam portion 235 is configured to turn about a cam shaft 235*c* as a fulcrum. The cam portion 235 includes the eccentric cam portion 235*a* eccentric with respect to the cam shaft 235*c* and the concentric cam portion 235*b* concentric with respect to the cam shaft 235*c*. As described above, when the lever arm 363 is turned from the "reset position" toward the "set position" side, the cam portion 235 is turned counterclockwise as shown in FIG. 25(A). At this time, since the eccentric cam portion 235*a* presses the first surface 246*a* of the first slider opening 246, the slider 240 is moved in the dismounting direction, indicated by an arrow, while being guided by the guide slits 241*a* and 241*b* and the shafts 262*a* and 262*b*.

When the lever arm 363 is in a position immediately in front of the "set position", the concentric cam portion 235*b* is in contact with the first surface 246*a* of the concentric cam portion 235*b*. A state in which the lever arm 363 is further turned up to the "set position" is shown in FIG. 25(B). That is, when the lever arm 363 is in the position immediately in front of the "set position", the slider 240 has already moved by the second predetermined stroke S2, which is necessary for mounting. Even if the lever arm 363 is subsequently turned from the position immediately in front of the "set position" to the "set position", since the concentric cam portion 235*b* is in contact with the first surface 246*a*, the slider 240 is not moved. That is, even when the lever arm 363 is further turned, so-called over-stroke does not occur in the distance that the slider 240 moves.

Therefore, the slider 240 can be configured not to follow the position (phase) of the lever arm 363 in a range. That is, the provision of "play" of about several degrees allows the slider 240 to move by the second predetermined stroke S2 in the mounting direction without full turning of the lever arm 363 to the "set position". In this case, even if the lever arm 363 is fully turned to the "set position", the distance that the slider 240 moves remains at the second predetermined stroke S2. As a result, the distance that the slider 240 moves in mounting of the ink cartridge 211 can be easily controlled.

For example, even if, during mounting of the ink cartridge 211, a user stops operation at a position immediately in front of the "set position" without appropriately turning the lever arm 363 up to the "set position", the slider 240 can be reliably moved by the second predetermined stroke S2. That is, even if the position at which a user stops the operation for the lever arm 363 varies, the slider 240 can be reliably moved by the second predetermined stroke S2 and the ink cartridge 211 can be mounted.

The term "position immediately in front of the 'set position'" as used herein refers to a position in between the "reset position" and the "set position" and the position is in the proximity of the "set position". The degree of proximity is preferably set such that, during mounting of the ink cartridge 211, the concentric cam portion 235*b* and the first surface 246*a* are in contact with each other at a position where a user tends to stop the lever arm 363.

In a state in which the slider 240 is moved by the second predetermined stroke S2 in the mounting direction, the first surface 246*a* is always in contact with the concentric cam portion 235*b*. In this state, an urging force of the dismounting lever 385 and the valve lever for urging the ink cartridge 211 in the dismounting direction is exerted on the ink cartridge 211, as described above. In addition, there is a possibility of generation of a force for causing the ink cartridge 211 to be disconnected from the ink supply needle 411 and to be urged in the dismounting direction. As a result, a force that will urge the slider 240 in the dismounting direction is always exerted on the slider 240. In this embodiment, when the mounting movement is completed, the cam portion 235 is always in contact with the first surface 246*a*. Therefore, even if the first surface 246*a* presses the concentric cam portion 235*b*, there is no possibility of generation of a force that will cause the cam portion 235 to turn about the cam shaft 235*c* as a fulcrum. As a result, even if an external force is exerted, there is no possibility that the slider 240 will move, unless the lever arm 363 is turned toward the "reset position" side.

In this embodiment, in a case in which the lever arm 363 is turned from the "set position" toward the "reset position" side, when the lever arm 363 is in a position immediately in front of the "reset position", the concentric cam portion 235*b* is in contact with the second surface 246*b*, as in a case in which the lever arm 363 is turned toward the "set position" side. That is, even if the lever arm 363 is not fully turned to the "reset position", the slider 240 can be moved by the second predetermined stroke S2 in the dismounting direction. In this case, even if the lever arm 363 is then fully turned to the "reset position", the distance that the slider 240 moves remains at the second predetermined stroke S2.

When the lever arm 363 is in the "reset position", the concentric cam portion 235*b* is in contact with the second surface 246*b*. Therefore, as described above, even if, after the ink cartridge 211 is inserted by the first predetermined stroke S1 from the insertion opening 271 and the ink cartridge 211 is held by the cartridge holding unit 210, an attempt to push the ink cartridge 211 further is made, unless the lever arm 363 is turned toward the "set position" side, it is impossible to move the slider 240 in the mounting direction. That is, even if an attempt to push the ink cartridge 211 by more than the first predetermined stroke S1, the abutment portions 243 of the slider 240 regulate the position of the ink cartridge 211.

The first engagement unit and the second engagement unit, which are described above, will now be described in greater detail below.

Figure 26:
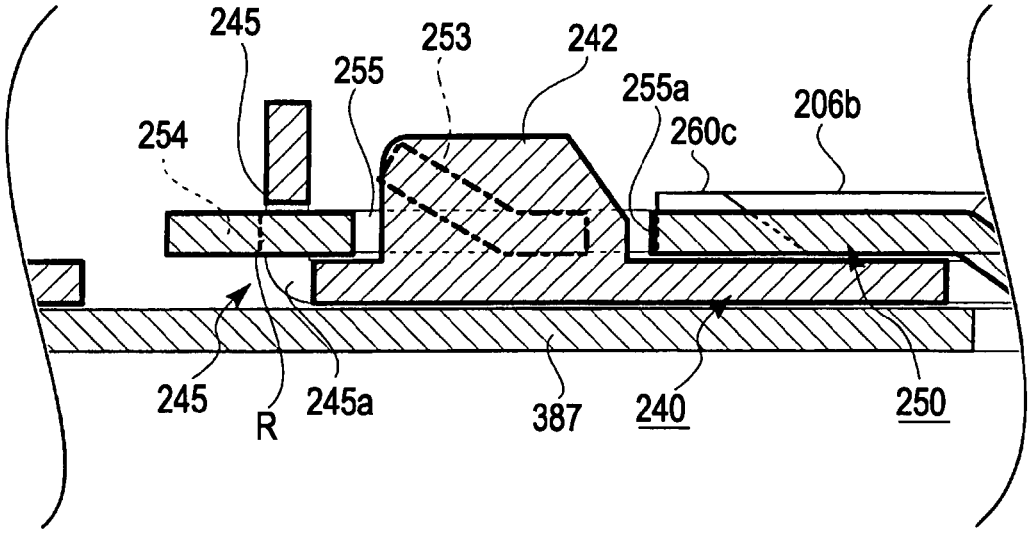
FIG. 26(A) and FIG. 26(B) are an enlarged sectional side view of an essential part and a plan view, respectively, during engagement of a first engagement unit.
Figure 26:
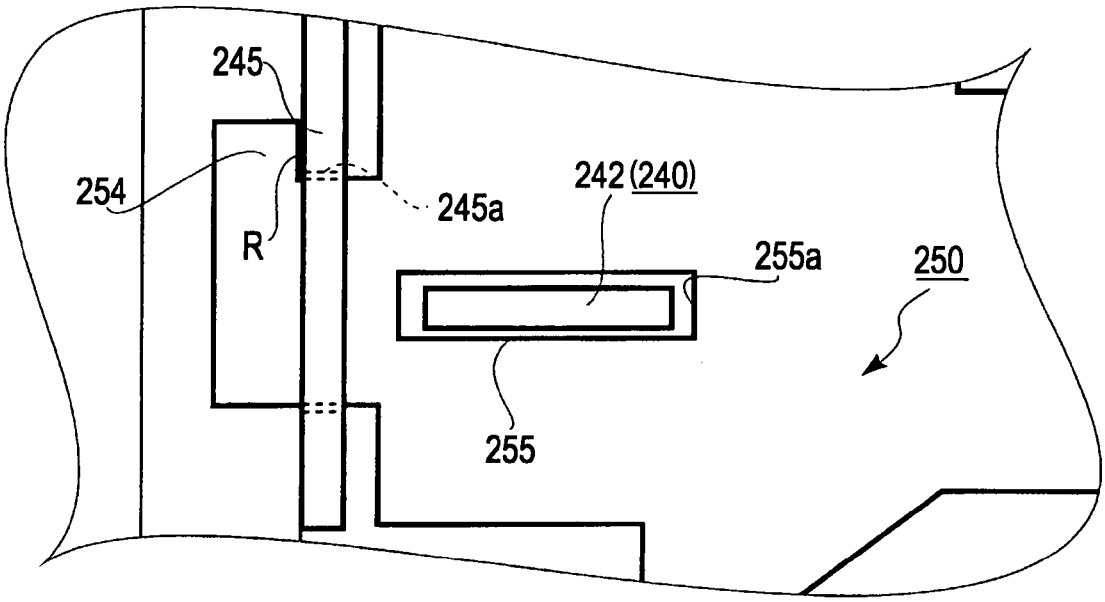

FIGS. 26(A) and 26(B) are enlarged views of an essential part of the attaching and detaching device when the latch plate is in a lowered state and an engaged state performed by the first engagement unit. FIG. 26(A) is an enlarged plan view of the essential part. FIG. 26(B) is a sectional side view of the essential part shown in FIG. 26(A).

A state shown in FIGS. 26(A) and 26(B) is the above-described state before completion of insertion of the ink cartridge 211 (see FIGS. 4 to 7), the above-described state during slight turning of the lever arm 363 from the "set position" toward the "reset position" side (see FIGS. 17 and 18), and the above-describe state after the latch plate 250 rises and then descends during dismounting of the ink cartridge 211 (see FIG. 24). The pair of first engagement units and the pair of second engagement units are disposed in the width direction, and the engagement units in the same pair perform the same operation. Here, one unit of each pair is described, and the description of the other is omitted.

As shown in FIGS. 26(A) and 26(B), with respect to the latch plate 250, the slider engagement portion 245 and the latch-plate engagement portion 254, which constitute the first engagement unit, are in surface contact with each other at a position R by an urging force of the above-described latch-plate spring 256. At this time, the slider projection 242 of the second engagement unit is separated from the mounting-direction surface 255*a* of the latch-plate slit 255. The latch-plate engagement portion 254 is in surface contact with the slider engagement portion 245 at the position R via an engagement opening portion 245*a* provided in the slider engagement portion 245.

Figure 27:
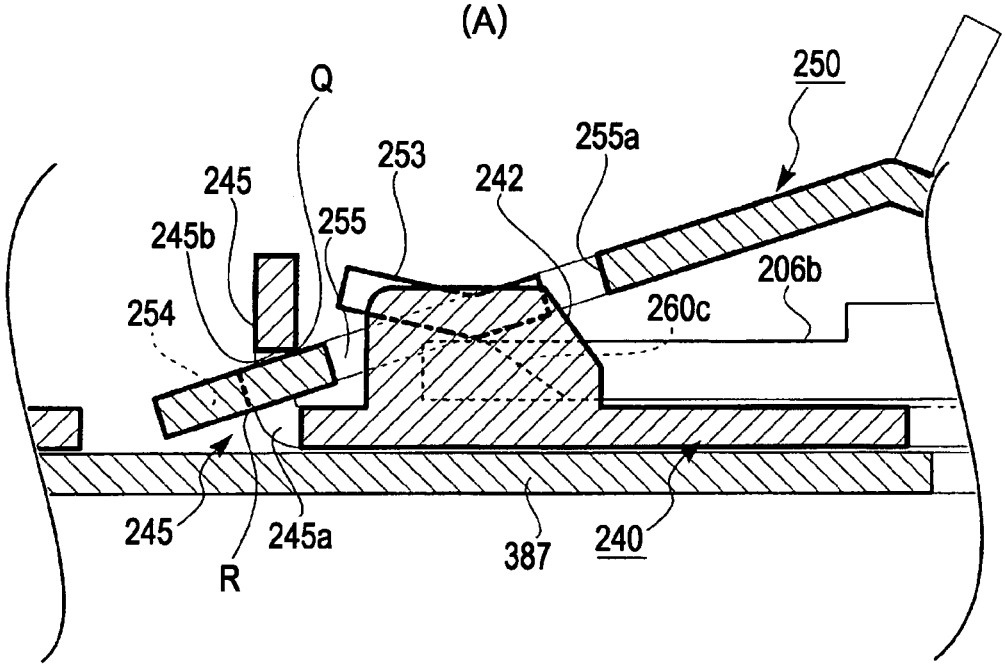
FIG. 27(A) and FIG. 27(B) are an enlarged sectional side view of an essential part and a plan view thereof, respectively, during engagement of the first engagement unit (the latch plate is raised).
Figure 27:
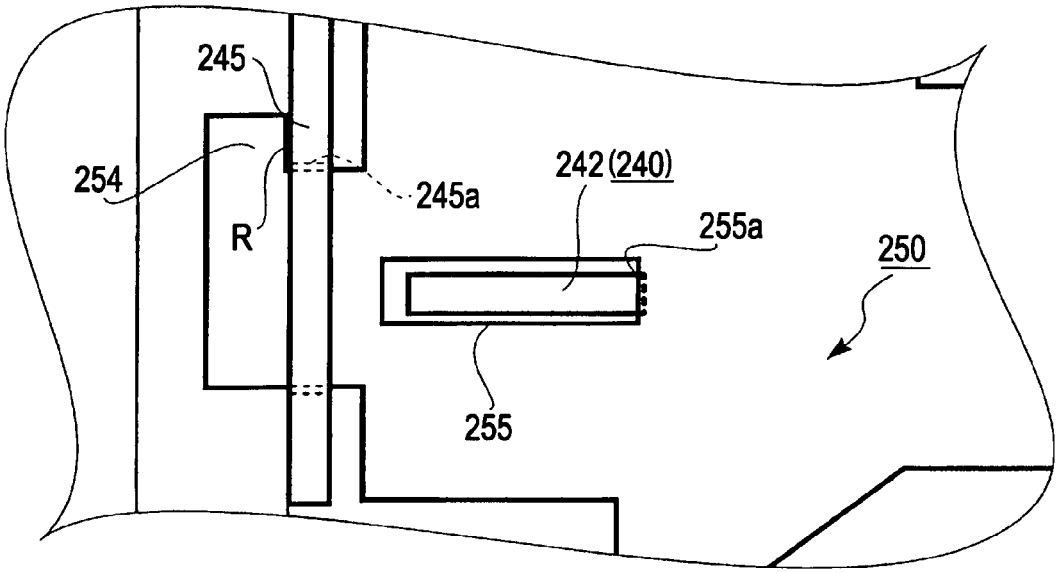

FIGS. 27(A) and 27(B) are enlarged views of an essential part of the attaching and detaching device when the latch plate is in a raised state and an engaged state performed by the first engagement unit. FIG. 27(A) is an enlarged plan view of the essential part. FIG. 27(B) is a sectional side view of the essential part shown in FIG. 27(A).

A state shown in FIGS. 27(A) and 27(B) is a state in which, during dismounting of the above-described ink cartridge 211, the end contact portions 260*c* of the cancelling arms 260*a* and 260*b* upwardly pushes the latch plate 250 via the oblique portions 253 (see FIGS. 19 to 21).

As shown in FIGS. 27(A) and 27(B), the latch plate 250 is upwardly pushed by an urging force of the latch-plate spring 256 and the end contact portions 260*c* while the slider engagement portion 245 and the latch-plate engagement portion 254, which constitute the first engagement unit, are in surface contact with each other. The path of each of the nail portions 251 of the latch plate 250 is an arc shape about the location, as a fulcrum, of engagement of the slider engagement portion 245 and the latch-plate engagement portion 254.

More specifically, as shown in FIG. 27(A), in a state in which the above-described latch-plate spring 256 downwardly urges a leading-end portion of the latch plate 250 where the nail portions 251 are provided, the end contact portions 260*c* upwardly push the latch plate 250. At this time, the end contact portions 260*c* upwardly push the oblique portions 253, which are disposed between an area of the latch plate 250 where the latch-plate spring 256 is provided and the first engagement unit. Therefore, the latch-plate engagement portion 254 comes into contact with an upper surface 245*b* of the engagement opening portion 245*a* and is pressed thereby. That is, a fulcrum for swinging of each of the nail portions 251 of the latch plate 250 is a position Q at which the upper surface 245*b* of the engagement opening portion 245*a* is in contact with the latch-plate engagement portion 254. At this time, the axial direction of the swing fulcrum Q is perpendicular to the mounting direction.

The distance from the first engagement units to the respective nail portions 251 can be accurately determined by the respective positions R, at each of which the slider engagement portion 245 and the latch-plate engagement portion 254, which serve as a swing-radius regulating unit, are in surface contact with each other. At this time, since the fulcrum position Q always remains unchanged, when the latch plate 250 swings, a point of the latch plate 250 where the upper surface 245*b* of the engagement opening portion 245*a* of the slider 240 (a point adjacent to the latch plate in the position Q) slightly slides toward the nail-portion side, which is the leading-end side, and toward a second-end side (in a direction from the nail portion toward the fulcrum) and the position R, where the slider engagement portion 245 and the latch-plate engagement portion 254 are in surface contact with each other, slightly vertically changes and moves.

Here, when each of the nail portions 251 swings upward, the surface-contact position R slightly moves downward, and the distance between the fulcrum Q and the position R is slightly increased. As a result, as each of the nail portions 251 upwardly swings, the distance between the fulcrum Q and the nail portion 251, which is the swing radius, is slightly reduced.

That is, individually providing the swing fulcrum Q and the position R, where the slider engagement portion 245 and the latch-plate engagement portion 254, which serve as the swing-radius regulating unit, are in surface contact with each other, causing the latch plate 250 to swing, and moving the position R close to or away from the fulcrum Q can vary the distance between the fulcrum Q and the nail portion 251 during swinging of the latch plate 250.

In other words, during upward swinging of the latch plate 250, the first engagement unit is configured to move the latch plate 250 such that the nail portions 251, which are provided at the leading end of the latch plate 250, is retracted and moved toward the first engagement unit, which acts as the swing fulcrum Q, and thus releasing of engagement with the depressions 211*a* is facilitated.

The present invention is an engagement device configured to, during releasing of a state in which the latch plate 250, which is an engaging member in the main body of the device, engages with and holds the ink cartridge 211, which is an engaged member, cause the latch plate 250, which is the engaging member, to swing while moving so as to be retracted in a direction in which releasing of engagement of the depressions 211*a*, which are an engaged unit in the engaged member, and the nail portions 251, which are an engaging unit in the engaging member, is facilitated. Therefore, by the shape of the nail portion 251 and the depression 211*a*, during releasing of engagement of the nail portions 251 and the depressions 211*a* by swinging of the latch plate 250, the latch plate may be moved such that the swing radius of each of the nail portions 251 is gradually increased. The engaged member is not limited to the ink cartridge. The shape of each of the engaging unit and the engaged unit is not limited to the shape of a nail and a depression.

During swinging of the latch plate 250 from an upper state to a lower original position (FIG. 26), the distance between the fulcrum Q and the surface-contact position R is reduced again. Therefore, the distance between the fulcrum Q and each of the nail portions 251 becomes the original length.

In this embodiment, as each of the nail portions 251 upwardly swing, the distance between the fulcrum Q and the nail portion 251 is slightly reduced. This can further reduce a possibility of occurrence of friction generated by contact of the nail portions 251 with the depressions 211*a* when engagement of the nail portions 251 and the depressions 211*a* becomes released and the nail portions 251 are extracted from the respective depressions 211*a*.

In this embodiment, the nail portions 251 are closer to the leading end than an area of the latch plate 250 where the latch-plate spring 256 is provided. Therefore, during insertion of the ink cartridge 211 by the first predetermined stroke S1 and engagement of the nail portions 251 and the depressions 211*a*, the latch-plate engagement portions 254 swing about the positions R as a fulcrum, at which the latch-plate engagement portions 254 are in surface contact with the respective slider engagement portions 245. At this time, since it is not necessary to consider the above-described clearance, even when the latch plate 250 swings about the positions R as a fulcrum, no problem arises. Here, the positional relationship between an area of the latch plate 250 where the latch-plate spring 256 is provided and the nail portions 251 can be reversed and swinging about the fulcrum Q can be performed in the same way as in releasing of engagement.

In this embodiment, the latch plate 250 is formed of a metal plate, and the thickness of the metal plate is on the order of about 1.0 mm.

In addition, the direction of urging of the latch-plate spring 256 can be changed, the latch-plate engagement portion 254 can come into contact with an area subjected to bending in the slider engagement portion 245, a so-called curved area, and the latch plate 250 can swing about the surface-contact position (R) as a fulcrum.

FIGS. 28(A) and 28(B) are enlarged views of an essential part of the attaching and detaching device when the latch plate is in a lowered state and an engaged state performed by the second engagement unit. FIG. 28(A) is an enlarged plan view of the essential part. FIG. 28(B) is a sectional side view of the essential part shown in FIG. 28(A).

A state shown in FIGS. 28(A) and 28(B) is a state in which, during mounting of the ink cartridge 211, the above-described lever arm 363 is turned from the "reset position" up to the "set position" (see FIGS. 11 to 16).

As shown in FIGS. 28(A) and 28(B), during mounting of the ink cartridge 211, the slider projection 242 and the mounting-direction surface 255*a* of the latch-plate slit 255 are in surface contact with each other, the slider projection 242 and the latch-plate slit 255 constituting the second engagement unit. At this time, engagement of the slider engagement portion 245 and the latch-plate engagement portion 254, which constitute the first engagement unit, becomes loose, and the slider engagement portion 245 is separated from the latch-plate engagement portion 254 and is not in surface contact therewith. Then, as the lever arm 363 is turned, the slider projection 242 comes into contact with and presses the mounting-direction surface 255*a* of the latch-plate slit 255. Therefore, the ink cartridge 211 can be accurately moved by the second predetermined stroke S2 via the latch plate 250.

The ink-cartridge attaching and detaching device 201 according to this embodiment slides the ink cartridge 211 and mounts the ink cartridge 211 on the main body of the recording apparatus. The ink-cartridge attaching and detaching device 201 includes the cartridge holding unit 210 configured to hold the ink cartridge 211 by insertion of the ink cartridge 211 by the first predetermined stroke S1 and the power transmitting and the converting mechanism 230 configured to ensure a pressing force required for mounting the ink cartridge 211 by leverage by turning of the lever arm 363 and to convert the turning of the lever arm 363 into the second predetermined stroke S2 required for mounting the ink cartridge 211 while held by the cartridge holding unit 210. The cartridge holding unit 210 includes the latch plate 250 being an integrated engagement member configured to engage with a surface of the ink cartridge 211, the surface being parallel to the mounting direction. When engaging with the ink cartridge 211, the latch plate 250 lies in the central portion in the width direction with respect to the mounting direction at the surface.

Figure 29:
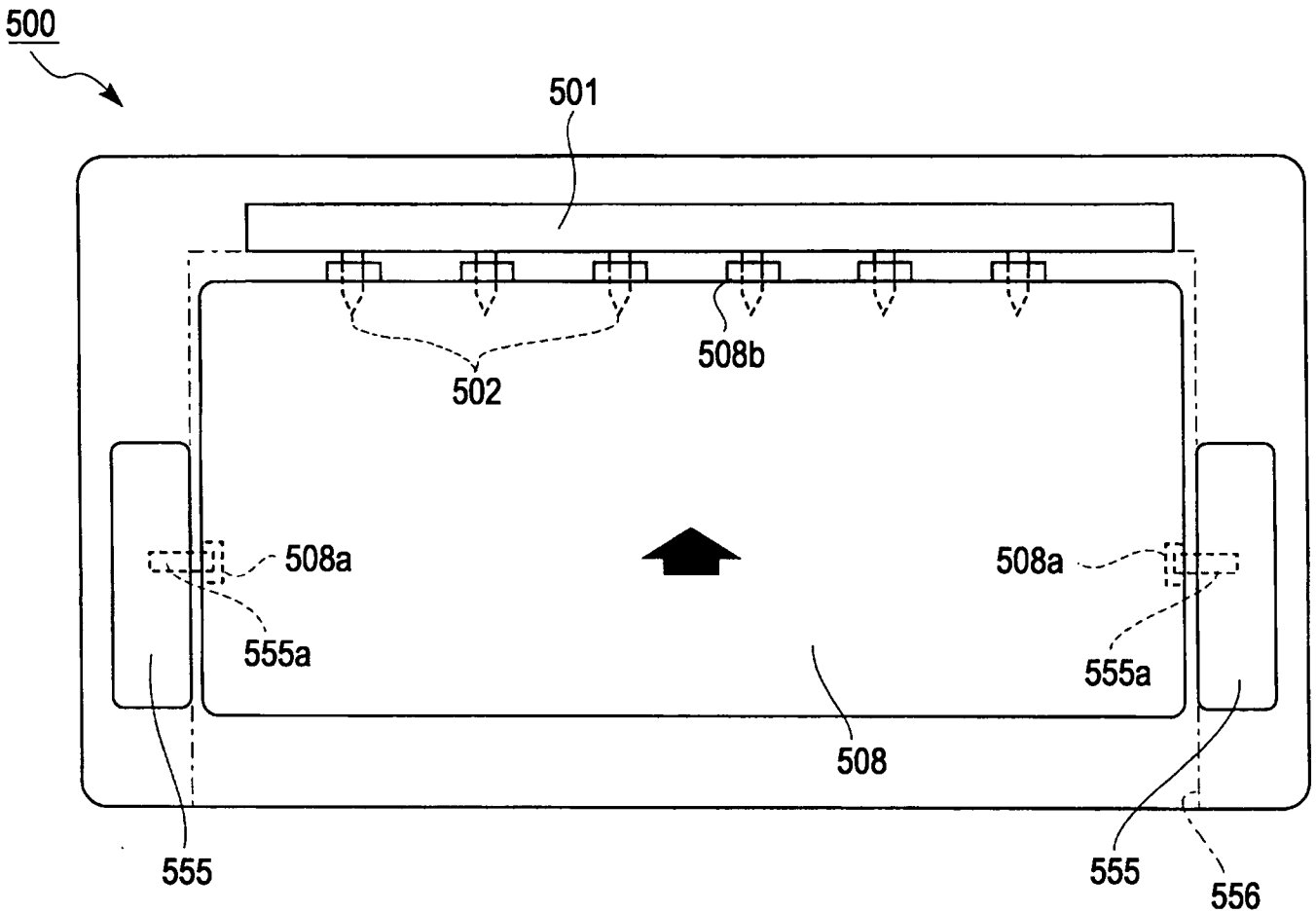
FIG. 29 is a plan view of a known ink-cartridge attaching and detaching device.

As a result, even if the ink cartridge 211 is inclined, there is no possibility that only one side of the ink cartridge 211 will be held, unlike known techniques, and the cartridge holding unit 210 can reliably hold the ink cartridge 211 at the central portion in the width direction. Since the latch plate 250 of the cartridge holding unit 210 is formed integrally, an incomplete state such as only one side being held does not occur in the first place. Compared with a known structure (see FIG. 29), the number of parts can be reduced.

The latch plate 250 being the engagement member according to this embodiment is formed integrally in the width direction with respect to the mounting direction and has the plurality of nail portions 251 for engaging with the ink cartridge 211. As a result, because engagement is attained by a plurality of locations, the attitude of the ink cartridge 211 can be stabilized.

The cartridge holding unit 210 according to this embodiment includes the slider 240 configured to move in response to a power from the power transmitting and converting mechanism, the latch plate 250 being an engagement member configured to engage with the slider 240, swing with respect to the slider 240, engage with the ink cartridge 211, hold the ink cartridge 211, and move in the mounting direction together with the slider 240, the slider engagement portion 245 and the latch-plate engagement portion 254, which constitute a first engagement unit configured to operate such that the slider 240 and the latch plate 250 directly engage with each other when the latch plate 250 swings, and the slider projection 242 and the latch-plate slit 255, which constitute a second engagement unit configured to operate such that the slider 240 and the latch plate 250 directly engage with each other when the latch plate 250 mounts the ink cartridge 211.

In other words, during insertion and movement for mounting and dismounting, by changing the location of engagement and contact of the slider 240 and the latch plate 250, the latch plate 250 maintains a swinging function without the provision of a shaft used for swinging.

As a result, compared with a case in which such shaft is provided, the positional accuracy of the nail portions 251 of the latch plate 250 can be improved.

In addition, the cartridge holding unit 210 according to this embodiment includes the latch-plate spring 256 as an urging unit. The latch-plate spring 256 is configured to, when the weight of the ink cartridge is not exerted during moving of the ink cartridge in the mounting direction, urge the latch plate 250, which is the engagement member, such that the latch plate 250 is engaged by the slider engagement portion 245 and the latch-plate engagement portion 254, which constitute the first engagement unit.

The cartridge unlocking unit 220 according to this embodiment is configured to, during moving of the ink cartridge 211 in the dismounting direction, urge the latch plate 250 such that the latch plate 250 is engaged with the slider 240 by the slider engagement portion 245 and the latch-plate engagement portion 254 as the first engagement unit and cause the latch plate 250, which is the engagement member, to swing.

In addition, the cartridge unlocking unit 220 is configured to, during mounting of the ink cartridge 211, urge the latch plate 250, which is the engagement member, such that the slider 240, the slider projection 242, and the mounting-direction surface 255*a* of the latch-plate slit 255 are in surface contact with one another, the slider projection 242 and the latch-plate slit 255 constituting the second engagement unit.

The first engagement unit according to this embodiment is configured such that, during swinging of the latch plate 250, which is the engagement member, and releasing of a state of holding the ink cartridge, in order to facilitate releasing engagement of the nail portions 251 of the latch plate 250 and the depressions 211*a* of the ink cartridge 211, a radius of swinging varies with swinging of the latch plate 250 by swinging the latch plate 250 while moving the latch plate 250 with respect to the slider 240.

The shape and the type of the cam portion according to the present invention are not limited to the above embodiment. For example, a grooved cam may be used.

In this embodiment, two nail portions are provided. However, a single nail portion extending in the width direction may be provided. Alternatively, three or more nail portions may be provided in the width direction.

In addition, in this embodiment, the swing fulcrum for the latch plate is positioned in the mounting direction upstream from the nail portions. However, it may be positioned downstream.

The present invention is not limited to the above-described embodiment. Various modifications may be made within the invention described in the claims and are included in the scope of the present invention.

REFERENCE NUMERALS

100: recording apparatus 101: hopper 102: carriage motor 103: paper guide 104: feeding motor 105: platen 106: recording head 107: carriage 110: ink supply tube 143: recording portion 144: feeding portion 190: frame member

200: ink suction device 201: attaching and detaching device 210: cartridge holding unit 211: ink cartridge

211*a*: depression 212: ink remaining information terminal 213: cap portion 220: cartridge unlocking unit 230: power transmitting and converting mechanism

231: first gear 232: second gear 233: third gear 234: fourth gear 235: cam portion 235*a*: eccentric cam portion 235*b*: concentric cam portion 235*c*: cam shaft 240: slider 241*a*: guide slit 241*b*: guide slit 241*c*: slit 242: slider projection 243: abutment portion

245: slider engagement portion 245*a*: engagement opening portion 245*b*: upper surface

246: first slider opening portion 246*a*: first surface 246*b*: second surface 247: second slider opening portion 250: latch plate 251: nail portion 252: shoulder portion 253: oblique portion 254: latch-plate engagement portion 255: latch-plate slit 255*a*: mounting-direction surface 256: latch-plate spring 260*a*: cancelling arm 260*b*: cancelling arm 260*c*: end contact portion 261: cancelling-arm spring 262*a*: shaft 262*b*: shaft 262*c*: shaft 271: insertion opening

363: lever arm 363*a*: knob 363*b*: arm body

363*c*: lever projection 363*d*: guide surface 364: lever shaft

366: lever turn regulation portion 369: lever turn regulation projection 385: dismounting lever 386: dismounting lever shaft 387: base 387*a*: base opening 401: extrusion lever 401*a*: contact portion 401*b*: extrusion portion 402: extrusion-lever spring 411: extrusion-lever spring

412: connector 413: connector spring 500: attaching and detaching device 501: channel section

502: ink supply needle 508: ink cartridge 508*a*: depression

508*b*: needle insertion port 555: cartridge holding unit 555*a*: latch projection 556: ink-cartridge insertion opening Q: fulcrum R: contact surface (of first engagement unit)

S1: first predetermined stroke S2: second predetermined stroke

S3: third predetermined stroke

What is claimed is:

1. An ink-cartridge attaching and detaching device for sliding an ink cartridge and mounting the ink cartridge on a main body of a recording apparatus, the ink-cartridge attaching and detaching device comprising:

a cartridge holding unit configured to hold the ink cartridge by insertion of the ink cartridge by a first predetermined stroke; and a power transmitting and converting mechanism configured to ensure a pressing force required for mounting the ink cartridge by leverage by turning of a lever arm and to convert the turning of the lever arm into motion of a second predetermined stroke required for mounting the ink cartridge while held by the cartridge holding unit, wherein the cartridge holding unit includes:

a slider configured to move in response to a power from the power transmitting and converting mechanism;

an engagement member configured to engage with the slider, swing with respect to the slider, engage with the ink cartridge, hold the ink cartridge, and move in the mounting direction together with the slider;

a first engagement unit configured to operate such that the slider and the engagement member directly engage with each other when the engagement member swings; and a second engagement unit configured to operate such that the slider and the engagement member directly engage with each other when the engagement member mounts the ink cartridge.

2. The ink-cartridge attaching and detaching device according to claim 1, wherein the slider and the engagement member are configured to, when the ink cartridge is inserted by the first predetermined stroke, be engaged by the first engagement unit, configured to, when the ink cartridge is moved in the mounting direction by the second predetermined stroke, be engaged under the weight of the ink cartridge by the second engagement unit, and configured to, when the ink cartridge is moved in a dismounting direction, be engaged by the first engagement unit.

3. The ink-cartridge attaching and detaching device according to claim 2, wherein the cartridge holding unit includes an urging unit, wherein the urging unit is configured to, when a force generated by the weight of the ink cartridge is not exerted during moving of the ink cartridge in the mounting direction, urge the engagement member such that the engagement member is engaged by the first engagement unit.

4. The ink-cartridge attaching and detaching device according to claim 1, wherein the second engagement unit includes:

a slider projection provided at the slider and extending in a direction in which the engagement member swings; and a slit portion provided in the engagement member, extending in the mounting direction, and allowing the slider projection to pass therethrough.

5. The ink-cartridge attaching and detaching device according to claim 1, wherein the cartridge holding unit includes a cartridge unlocking unit configured to, during moving of the ink cartridge from a state of being mounted to a direction in which the ink cartridge is to be dismounted, unlock engagement of the engagement member and the ink cartridge.

6. The ink-cartridge attaching and detaching device according to claim 5, wherein the cartridge unlocking unit is configured to, during moving of the ink cartridge in the dismounting direction, urge the engagement member such that the engagement member is engaged with the slider by the first engagement unit and cause the engagement member to swing.

7. The ink-cartridge attaching and detaching device according to claim 5, wherein the cartridge unlocking unit is configured to, during mounting of the ink cartridge, urge the engagement member such that the engagement member is engaged with the slider by the second engagement unit.

8. The ink-cartridge attaching and detaching device according to claim 1, wherein the first engagement unit is configured such that, during swinging of the engagement member and releasing of a state of holding the ink cartridge, in order to facilitate releasing engagement of the engagement member and the ink cartridge, a radius of swinging varies with swinging of the engagement member by swinging the engagement member while moving the engagement member with respect to the slider.

9. A liquid ejecting apparatus including a liquid-cartridge attaching and detaching device for sliding a liquid cartridge and mounting the liquid cartridge on a main body of the liquid ejecting apparatus, the liquid ejecting apparatus comprising:

a cartridge holding unit configured to hold the liquid cartridge by insertion of the liquid cartridge by a first predetermined stroke; and a power transmitting and converting mechanism configured to ensure a pressing force required for mounting the liquid cartridge by leverage by turning of a lever arm and to convert the turning of the lever arm into motion of a second predetermined stroke required for mounting the liquid cartridge while held by the cartridge holding unit, wherein the cartridge holding unit includes:

a slider configured to move in response to a power from the power transmitting and converting mechanism; an engagement member configured to engage with the slider, swing with respect to the slider, engage with the liquid cartridge, hold the liquid cartridge, and move in the mounting direction together with the slider;

a first engagement unit configured to operate such that the slider and the engagement member directly engage with each other when the engagement member swings; and a second engagement unit configured to operate such that the slider and the engagement member directly engage with each other when the engagement member mounts the liquid cartridge.

* * * * *